US006752339B2

(12) United States Patent
Moriya et al.

(10) Patent No.: US 6,752,339 B2
(45) Date of Patent: Jun. 22, 2004

(54) MOBILE CRUSHING APPARATUS

(75) Inventors: Yukio Moriya, Hayama-machi (JP); Toor Nakayama, Kamakura (JP); Kaoru Nishihara, Kawasaki (JP); Hiroyuki Umeda, Kawasaki (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/885,972

(22) Filed: Jun. 22, 2001

(65) Prior Publication Data

US 2001/0054657 A1 Dec. 27, 2001

(30) Foreign Application Priority Data

Jun. 22, 2000 (JP) ..... 2000-188386
Jun. 30, 2000 (JP) ..... 2000-200025

(51) Int. Cl.[7] ..... B02C 21/02
(52) U.S. Cl. ..... 241/101.74
(58) Field of Search ..... 241/101.74, 186.35, 241/101.742

(56) References Cited

U.S. PATENT DOCUMENTS 4,073,445 A * 2/1978 Clonch ..... 241/101.74
4,655,402 A * 4/1987 Desourdy ..... 241/101.74
4,717,081 A * 1/1988 Hamilton ..... 241/101.74
5,215,264 A * 6/1993 Lundquist ..... 241/37.5
5,445,330 A 8/1995 Rashwan et al. ..... 241/78
5,590,842 A * 1/1997 Zehr ..... 241/186.35
5,655,719 A * 8/1997 Getz ..... 241/101.76
5,669,562 A * 9/1997 Smith ..... 198/313

FOREIGN PATENT DOCUMENTS

| | | |
|---|---|---|
| JP | 5-138059 | 6/1993 |
| JP | 9-24290 | 1/1997 |
| JP | 2809598 | 7/1998 |

* cited by examiner

*Primary Examiner*—Mark Rosenbaum
(74) *Attorney, Agent, or Firm*—Armstrong, Kratz, Quintos, Hanson & Brooks, LLP.

(57) ABSTRACT

The invention provides a mobile crushing apparatus which is compact and light, has an improved assembling property and maintaining property, and has an improved operability for changing to a traveling attitude. Accordingly, in the apparatus provided with a crusher (10) crushing rocks or the like and a supply conveyor (41) for supplying a material to be crushed, which are mounted on a frame (2), the supply conveyor is provided in one side in a width direction of the frame, and an input shaft (16) for inputting a driving power to the crusher is provided in another side in the width direction of the frame. A power source (30) for the crusher and the supply conveyor is arranged in a stand (5) so as to constitute a power unit (4) and mounted to the frame via the stand.

3 Claims, 28 Drawing Sheets

MOBILE CRUSHING APPARATUS

FIELD OF THE INVENTION

The present invention relates to a mobile crushing apparatus provided with a crusher for rocks or the like, a supply conveyor for a material to be crushed and a power source for the crusher and the supply conveyor.

BACKGROUND OF THE INVENTION

In the conventional art, there has been frequently employed a mobile crushing apparatus for crushing rocks or the like and manufacturing a concrete aggregate or the like, and in recent years, in order to manufacture the aggregate near a rock mining field or the like, there has been seen a mobile crushing apparatus freely traveling between the working fields. As a first embodiment of the prior arts, there is a structure disclosed in Japanese Patent No. 2809598. FIG. 27 is a side elevational view of a mobile crushing apparatus 50 disclosed in the publication mentioned above, and FIG. 28 is a plan view of the same. In FIGS. 27 and 28, a frame 51 is attached on a crawler type traveling apparatus 3, and a cone type crusher 10 is mounted in a substantially center portion of the frame 51. A supply conveyor 41*a* for supplying a material to be crushed to the crusher 10 is arranged in a right side of the frame 51 with respect to a vehicle in such a manner as to be substantially parallel to a longitudinal direction. A vibrating screen 40 for separating a product and supplying the material to the crusher 10 is arranged in a front side in the longitudinal direction of the frame 51. A product conveyor 42 for discharging the separated product to an external portion is provided below the vibrating screen 40 so as to be directed forward and upward, and a discharge conveyor 43*a* for discharging the crushed material is provided below the crusher 10 so as to be directed rearward and upward. Although no specific description is given in the publication mentioned above, a power source 30*a* such as an engine for generating power for the traveling apparatus 3, the crusher 10, the vibrating screen 40, the supply conveyor 41*a* and the like is mounted on a rear portion of the frame 51.

The cone type crusher 10 is structured such as to crush in accordance with a rotary power output from an input shaft 16. In FIG. 28, the input shaft 16 is provided so as to be directed to an opposite side to the vibrating screen 40 in the longitudinal direction of the frame 51, that is, rearward, and an electric motor 52 arranged in the vehicle side portion opposite to the supply conveyor 41*a* and a belt pulley (not shown) of the input shaft 16 are connected by a V belt 23. A hydraulic unit 53 (a hydraulic pump) for driving the conveyor or the like and a power generator 54 driven by the engine are arranged at the rear of the crusher 10. A hydraulic apparatus 55 for driving the traveling apparatus 3 is mounted on a rear portion of the electric motor 52, the electric motor 52 and the hydraulic apparatus 55 constitute a drive source, and the hydraulic unit 53 and the power generator 54 constitute a power source 30*a*.

FIG. 30 is a plan view of a mobile crushing apparatus 60 in accordance with a second embodiment of the prior art. The crusher 10 is mounted on a substantially center portion of a frame 61, and the vibrating screen 40 is provided in a front portion in a longitudinal direction of the frame 61. A supply conveyor 41*b* is arranged in the frame 61 disposed in a left side of the crusher 10 and the vibrating screen 40 so as to be along the longitudinal direction. The input shaft 16 of the crusher 10 is arranged in a perpendicular direction to the longitudinal direction and toward the side of the supply conveyor 41*b*. The electric motor 52 for driving the crusher is arranged at the rear of the crusher 10, and both of the elements are connected by a belt pulley (not shown) of the input shaft 16 and a V belt 23.

However, the prior arts mentioned above have the following problems.

(1) In the first embodiment, since the input shaft 16 of the crusher 10 is arranged so as to be directed in the longitudinal direction as mentioned above, it is necessary to provide a gap T (a working space) longer than the input shaft 16 between the crusher 10 and the hydraulic unit 53 and the power generator 54 in order to easily perform a drawing operation at a time of dissembling and assembling the input shaft 16, as shown in FIG. 29. Accordingly, since the length in the longitudinal direction is increased and a whole size of the mobile crushing apparatus is increased, a weight thereof is increased and a cost therefor is increased.

(2) In the first embodiment, since the electric motor 52, the hydraulic unit 53, the power generator 54 and the hydraulic apparatus 55 are respectively arranged on the frame 51 in an independent manner, as shown in FIG. 28, a lot of time is required for an assembling operation and a wide space for mounting is required, so that a size of the apparatus is increased and a cost therefor is increased.

(3) In the second embodiment, since the input shaft 16 of the crusher 10 is arranged so as to be directed to the side of the supply conveyor 41, as shown in FIG. 30, earth and sand dropped down from the supply conveyor 41 fall on the drive portion such as the V belt 23, the electric motor 52 and the like, thereby causing an early abrasion of the V belt 23 and a trouble of the drive portion. Further, since the input shaft 16 is positioned below the supply conveyor 41*b*, it is hard to use a crane for assisting the work at a time of dissembling and assembling the input shaft 16, so that it is hard to perform the dissembling and assembling work.

Further, as a third embodiment of the prior art, there is a structure disclosed in Japanese Unexamined Patent Publication No. 5-138059. FIG. 31 is a side elevational view showing a working attitude of a mobile crushing apparatus 90 disclosed in the publication mentioned above. In FIG. 31, the crusher 10 for crushing the rocks or the like is mounted on a substantially center portion in a longitudinal direction of a frame 95 provided with the traveling apparatus 3. The vibrating screen 40 for classifying a grain size of the product is mounted in a front portion in the longitudinal direction of the frame 95 via a vertically moving apparatus 91 in such a manner as to freely move vertically. Further, a supply conveyor 41*c* for transferring the material to be crushed to the vibrating screen 40 is arranged in a left side portion of the frame 95 so as to be inclined upward in the side of the vibrating screen 40. The supply conveyor 41*c* is attached so as to be freely swung around the a supporting point 92 in the longitudinal direction by a swinging link apparatus 93. Further, a product conveyor 42 for discharging the product forward and upward is provided below the vibrating screen 40. Outriggers 94 and 94 are provided in right and left of a front end portion of the frame 95, and are structured such as to be grounded at a time of crushing work.

FIG. 32 is a side elevational view showing a traveling attitude of the mobile crushing apparatus 90. At a time of traveling, as shown in FIG. 32, the ground of the right and left outriggers 94 and 94 is canceled, and the vibrating screen 40 and the product conveyor 42 are descended by the vertically moving apparatus 91. Further, the supply conveyor 41*c* is vertically swung around the supporting point 92 by the swinging link apparatus 93 so as to be in a substantially horizontal attitude, whereby a height of a whole of the apparatus is reduced so as to make the apparatus easily pass through a tunnel or the like.

Further, in the mobile crushing apparatus 50 in accordance with the first embodiment, as shown in FIG. 27, the crusher 10 is mounted on the substantially center portion in the longitudinal direction of the frame 51 provided with the traveling apparatus 3, and the vibrating screen 40 is mounted in the front portion in the longitudinal direction. The supply conveyor 41*a* is arranged in the side portion of the frame 51 so as to be higher in the side of the vibrating screen 40. Bending and driving means 57 attaching a rear end portion 41*d* of the supply conveyor 41*a* by a pin so as to freely swing vertically and bending the rear end portion 41*d* upward is provided in a rear portion of the supply conveyor 41*a*, and a belt tension adjusting apparatus 58 is provided there. Further, the right and left outriggers 59 and 59 are provided in the front end portion of the frame 51.

At a time of crushing work, the rear end portion 41*d* of the supply conveyor 41*a* is set on the same straight line as shown in a solid line in the drawing, and the right and left outriggers 59 and 59 are grounded. On the contrary, the ground of the right and left outriggers 59 and 59 is canceled at a time of traveling, the rear end portion 41*d* of the supply conveyor 41*a* is bent by the bending and driving means 53 as shown by a double-dot chain line, and is ascended to a substantially horizontal position. Accordingly, a minimum ground clearance c of the rear end portion 41*d* is increased, thereby preventing an interference with respect to a ground obstacle.

However, the prior arts mentioned above have the following problems.

(4) In the third embodiment, it is necessary to operate the vertically moving apparatus 91 and the swinging link apparatus 93 for changing to the traveling attitude, so that the work becomes complex. Due to the apparatuses, the structure of the mobile crushing apparatus becomes complex, and the cost thereof is increased. Further, since the minimum ground clearance d of the product conveyor 42 in the traveling attitude is not sufficiently high as shown in FIG. 32, there is a case that the product conveyor 42 is in contact with the ground surface at a time of traveling, particularly at a time of climbing up or traveling on a rolling ground, thereby being damaged, so that a traveling performance is not good.

(5) In the moving type crushing apparatus disclosed in the first embodiment, it is also necessary to structure the rear end portion 41*d* of the supply conveyor 41*a* such as to freely swing vertically, and accordingly it is necessary to provided a belt tension adjusting apparatus 58, so that the structure becomes complex. Further, since the bending and driving means 57 is positioned below the supply conveyor 41*a*, there is a risk that the bending and driving means 57 is brought into contact with the obstacle during the travel of the vehicle, thereby being damaged.

DISCLOSURE OF THE INVENTION

The present invention is made by taking the problems mentioned above into consideration, and an object of the present invention is to provide a mobile crushing apparatus which is compact and light, has an improved assembling property and maintaining property, has an improved operability for changing to a traveling attitude, has a simple structure and is not interfered with an obstacle during a travel of a vehicle.

In order to achieve the object mentioned above, in accordance with a first aspect of the present invention, there is provided a mobile crushing apparatus comprises a frame, a crusher mounted on the frame and crushing rocks or the like, and a supply conveyor for supplying a material to be crushed to the crusher, wherein the supply conveyor is provided in one side in a width direction of the frame, and an input shaft for inputting a driving power to the crusher is provided in another side in the width direction of the frame.

In accordance with the first aspect, since the input shaft for inputting the driving power of the crusher is provided in another side opposite to one side in the width direction of the frame in which the supply conveyor is provided, it is unnecessary to provide a working space for drawing out and attaching the input shaft in front of or at the rear of the crusher in the manner of the prior arts, whereby it is possible to reduce the length in the longitudinal direction of the frame and it is possible to reduce the size of the whole of the mobile crushing apparatus. Further, it is possible to prevent the driving portion such as the input shaft, the V belt driving the input shaft and the like from being abraded or damaged due to the earth and sand, the stones and the like falling down from the supply conveyor, thereby improving a service life of the driving portion. Further, since no obstacle exists above the input shaft, a crane for assisting the work can be used at a time of maintaining the input shaft, so that the work can be very easily performed. Further, in the case that the input shaft is provided so as to be directed outward in the opposite side to the supply conveyor disposed in the width direction of the frame, no obstacle exists at a time of dissembling and assembling the input shaft, so that it is possible to easily draw out or attach the input shaft from or to the side portion of the vehicle. Accordingly, a maintainability is improved.

In accordance with a second aspect of the present invention, there is provided a mobile crushing apparatus comprises a frame, a crusher crushing rocks or the like, a supply conveyor for supplying a material to be crushed to the crusher, a power source for the crusher and the supply conveyor, and the crusher, the supply conveyor and the power source being mounted on the frame, wherein the power source is arranged in a stand so as to constitute a power unit, and the power unit can be mounted on the frame via the stand.

In accordance with the second aspect, since the power source is united and attached, in addition to the respective equipment of the power source, that is, an engine, a radiator and a hydraulic pump, a fuel tank, a working fluid tank, an operating valve portion and the like can be structured in a compact manner, so that a compact size can be achieved. Further, since the power unit can be previously assembled as a sub-assembly, an assembling operation can be easily performed, an assembling time can be reduced and a manufacturing cost can be reduced.

In accordance with a third aspect of the present invention, there is provided a mobile crushing apparatus comprises a frame having a traveling apparatus; a crusher crushing locks or the like, a supply conveyor for transferring a material to be crushed to the crusher, and the crusher and the supply conveyor being mounted on the frame, wherein the mobile crushing apparatus further comprises a slide apparatus supporting the supply conveyor so as to freely move in a longitudinal direction, and a slide power portion moving the supply conveyor by the slide apparatus.

In accordance with the third aspect, it is possible to move the supply conveyor in a state of directing the supply conveyor upward in the longitudinal direction by the slide apparatus, whereby it is possible to make a minimum ground clearance of the lower end portion of the supply conveyor sufficiently high. Accordingly, there is no risk that the supply conveyor is brought into contact with an obstacle or the like on the ground at a time of climbing up or traveling on a rolling ground, so that it is possible to rapidly move between the working fields without damaging the supply conveyor. Further, since a simple mechanism such as the slide is employed, the structure becomes simple, it is possible to easily move the supply conveyor and it is possible to easily change to a moving attitude.

In accordance with a fourth aspect of the present invention, there is provided a mobile crushing apparatus as recited in the third aspect, wherein the slide apparatus is provided with a roller and a rail having a groove engaged with the roller, the roller is rotatably attached to the frame, and the rail is provided in the supply conveyor.

In accordance with the fourth aspect of the present invention, since the structure is made such that the roller rotatably attached to the frame is engaged with the rail provided in the supply conveyor so as to support the supply conveyor by the roller, a contact point between the roller and the rail becomes a surface in an upper side of the groove, whereby the contact surface becomes directed downward, so that no earth and sand or the like are stored in the contact surface. Accordingly, an abrasion between the roller and the rail is reduced and a durability is improved. Further, the roller can smoothly rotate, a trouble is reduced and a moving operation of the supply conveyor can be easily performed.

In accordance with a fifth aspect of the present invention, there is provided a mobile crushing apparatus as recited in the third aspect, wherein the slide power portion is provided with a hydraulic cylinder moving the supply conveyor, the hydraulic cylinder is arranged so that a cylinder head portion is directed downward the supply conveyor, and a cylinder bottom portion and a rod head portion of the hydraulic cylinder are respectively attached to a side of the supply conveyor and a side of the frame.

In accordance with the fifth aspect of the present invention, since the vehicle can be changed to the moving attitude only by supplying a pressurized fluid to the bottom portion of the hydraulic cylinder so as to extend the hydraulic cylinder and sliding the supply conveyor upward, the structure becomes simple and the operation can be significantly easily performed. Further, since the hydraulic cylinder is arranged so that the cylinder head portion is directed downward the supply conveyor, there is a little possibility that the earth and sand or the like fall on the cylinder rod portion. Accordingly, it is possible to prevent the cylinder rod from being damaged or abraded, and a service life can be extended.

Granted that the hydraulic cylinder is mounted in the opposite direction to that of the present structure, that is, in the case that the cylinder bottom portion is attached to side of the frame and the rod head portion is attached to the side of the supply conveyor, it is necessary to newly provide a fixing member of a cylinder bottom portion for preventing the hydraulic cylinder from buckling at a time of being extended, in the side of the frame, so that the structure becomes complex. However, if the cylinder bottom portion is attached to the side of the supply conveyor in the manner of the present structure, the structure for preventing the hydraulic cylinder from buckling becomes simple. Further, since the side of the cylinder bottom having a large hydraulic pressure receiving area is positioned above the side of the head, it is possible to apply a great driving force for moving the supply conveyor upward on the basis of a small supply pressure, so that it is possible to make the hydraulic cylinder narrow.

DETAILED DESCRIPTION OF PREFERRED EMBODIMENTS

A description will be in detail given below of embodiments of a mobile crushing apparatus in accordance with the present invention with reference to the accompanying drawings.

Figure 1:
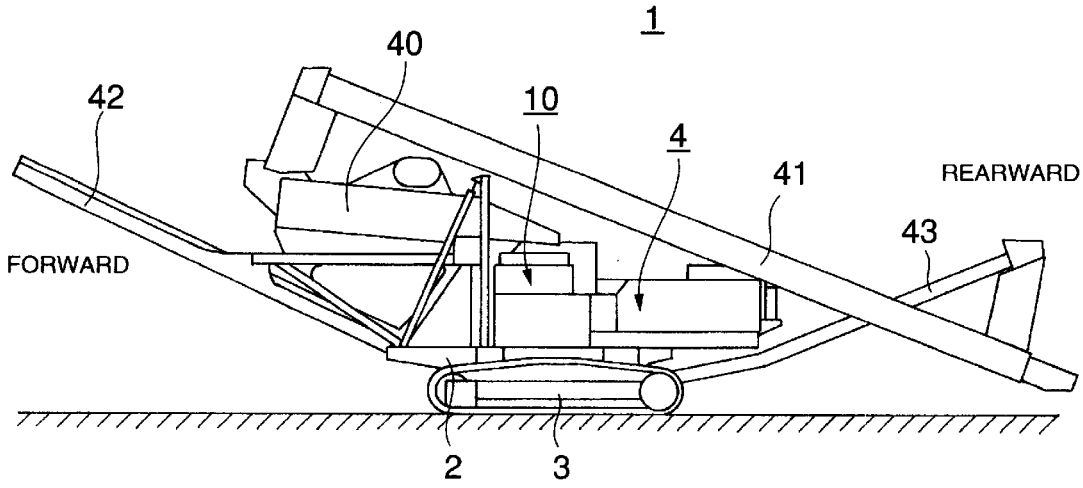
FIG. 1 is a side elevational view of a mobile crushing apparatus in accordance with a first embodiment of the present invention.
Figure 2:
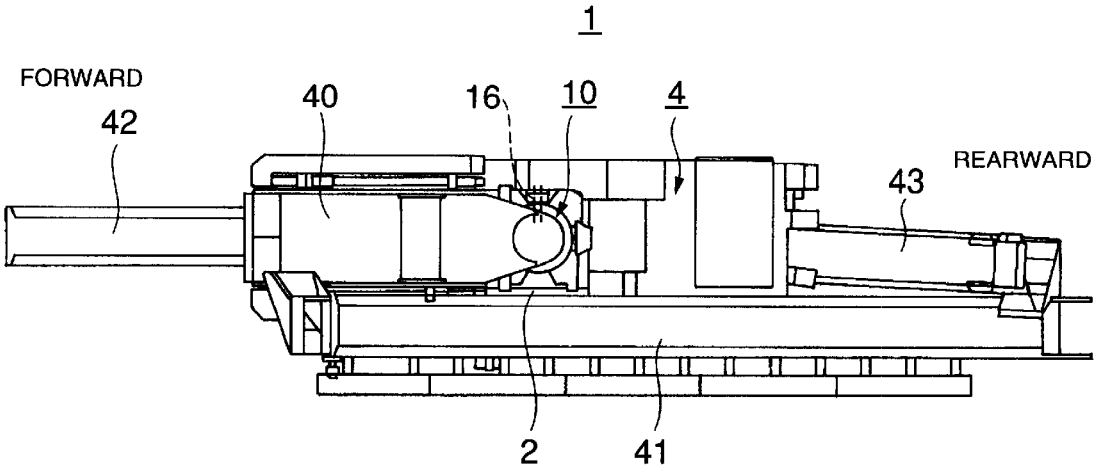
FIG. 2 is a plan view of the mobile crushing apparatus shown in FIG. 1.

FIG. 1 is a side elevational view of a mobile crushing apparatus 1 in accordance with a first embodiment, and FIG. 2 is a plan view of the same. In this case, forward and rearward respectively correspond to a forward direction and a rearward direction of the mobile crushing apparatus 1.

In FIGS. 1 and 2, a cone type crusher 10 is mounted in a substantially center portion of a frame 2 attached to a crawler type traveling apparatus 3. A vibrating screen 40 selecting a grain size of a product (a material to be crushed) and supplying the material to the crusher 10 is arranged in the frame in front of the crusher 10, and a power unit 4 is attached to the frame 2 at the rear of the crusher 10. A supply conveyor 41 for supplying the material to the vibrating screen 40 is arranged in any one side portion (a left side in the present embodiment) in a lateral direction of a vehicle of the frame 2 in such a manner as to be parallel to a longitudinal direction of the frame 2 and inclined forward and upward. A product conveyor 42 for discharging the product is provided below the vibrating screen 40 in such a manner as to be directed forward and upward, and a return conveyor 43 for again returning the crushed material to the supply conveyor 41 is provided below the crusher 10 in such a manner as to be directed rearward and upward.

In the mobile crushing apparatus 1, the grain size of the material loaded on the supply conveyor 41 from a loader (not shown) is selected by the vibrating screen 40, and only the material having the grain size corresponding to a specification drops down from the vibrating screen 40 and is discharged as the product to the external portion by the product conveyor 42. The material other than the product (having the grain size not corresponding to the specification) is fed to the crusher 10 so as to be crushed, and is further returned to the supply conveyor 41 by a return conveyor 43. The return material is again supplied to the vibrating screen 40 together with the material loaded from the loader, and the product is produced by repeating the operation mentioned above. The mobile crushing apparatus 1 can be moved by a traveling apparatus 3, can self-propel to a lock mining field and can produce an aggregate product in the working field.

Figure 3:
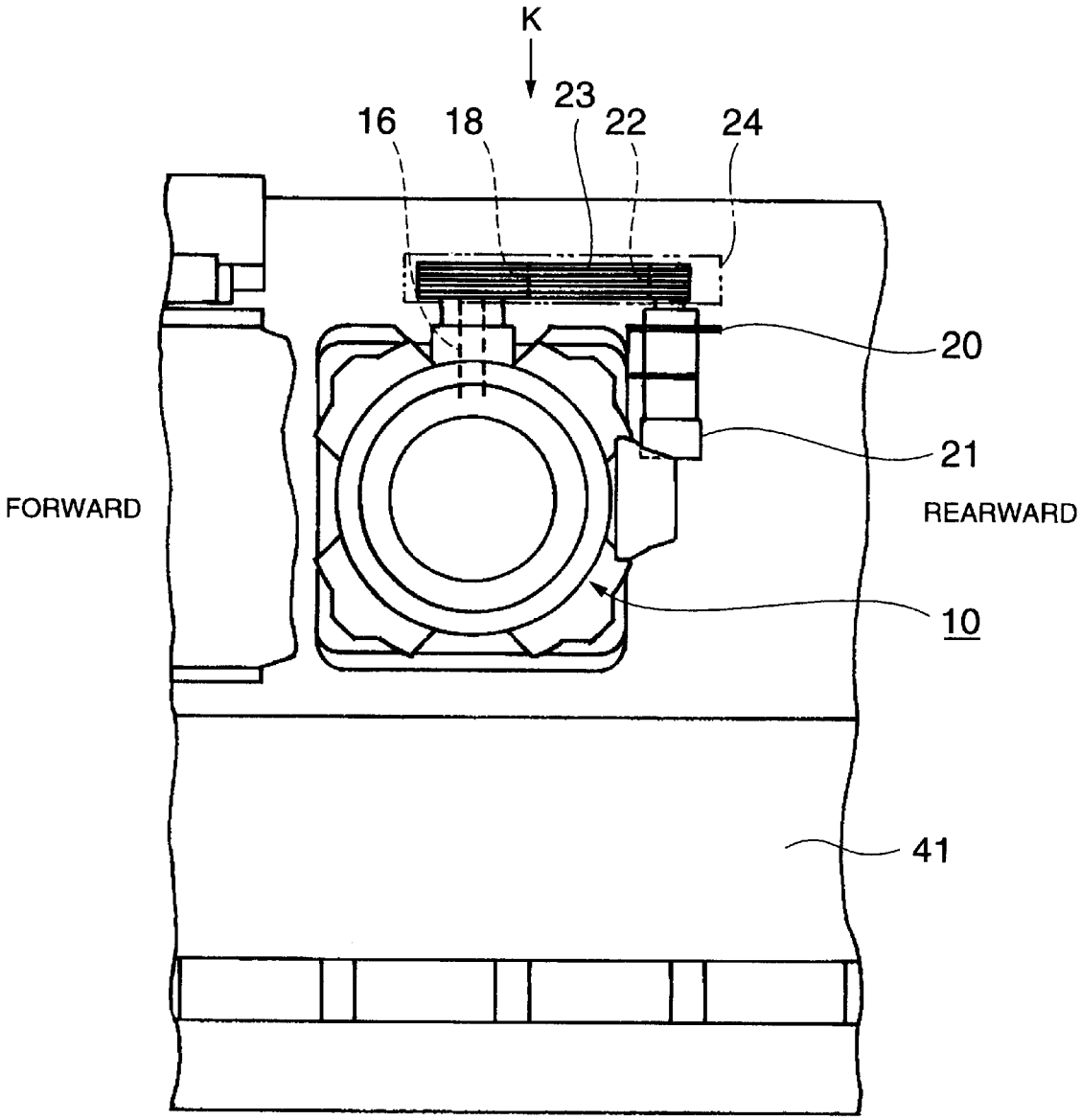
FIG. 3 is an enlarged plan view with respect to a drive portion of a crusher shown in FIG. 2.
Figure 4:
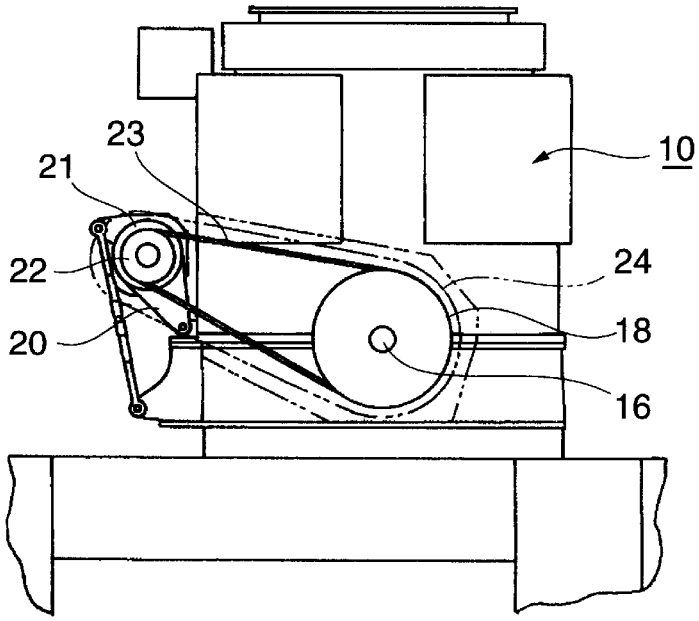
FIG. 4 is a side elevational view as seen from an arrow K with respect to the drive portion shown in FIG. 3.

FIG. 3 is a plan view of a drive portion for the crusher 10, and FIG. 4 is a side elevational view as seen from an arrow K in FIG. 3. As shown in FIG. 3, an input shaft of the crusher 10 is arranged in such a manner as to be directed to a perpendicular direction to a longitudinal direction of the supply conveyor 41 and an opposite side to the supply conveyor 41. In FIGS. 3 and 4, a base end portion of a bracket 20 is attached to a side surface portion of the crusher 10 so as to freely swing vertically, and a hydraulic motor 21 is attached to another end portion of the bracket 20. A drive pulley 22 attached to the hydraulic motor 21 and a belt pulley 18 attached to the input shaft 16 of the crusher 10 are connected to each other by a V belt 23. A tension of the V belt 23 is adjusted by swinging the bracket 20 vertically. Further, a dustproof cover 24 shown by a narrow double-dot chain line is provided in a periphery of the V belt 23. In this case, the input shaft 16 is arranged in a perpendicular direction to the longitudinal direction of the supply conveyor 41, however, the structure is not limited to this, may be arranged in any directions as far as dissembling and assembling of the input shaft 16 is not disturbed.

Figure 5:
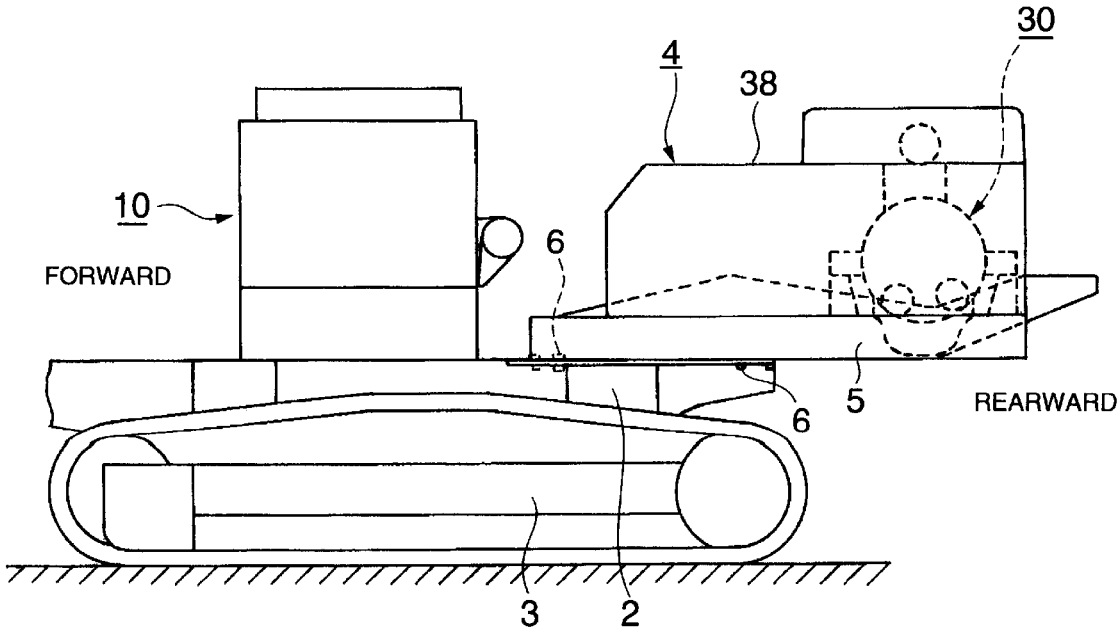
FIG. 5 is a side elevational view of a power unit in accordance with the first embodiment.
Figure 6:
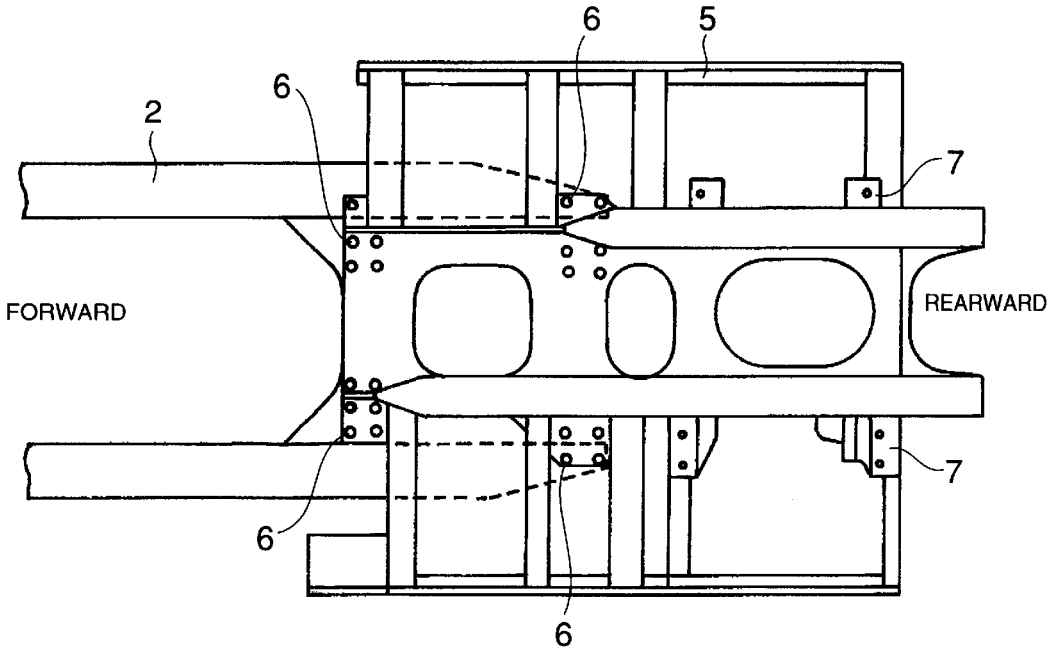
FIG. 6 is an enlarged plan view of a stand of the power unit.

Next, a description will be given of the power unit 4 with reference to FIG. 5. A power source 30 is mounted on a stand 5 so as to constitute the power unit 4, and the stand 5 is fastened to a rear upper surface of the frame 2 by a bolt 6. As shown in FIG. 6 corresponding to a plan view of the stand 5, the stand 5 has engine mounting tables 7 and is fastened to the frame 2 by a plurality of bolts 6.

Figure 7:
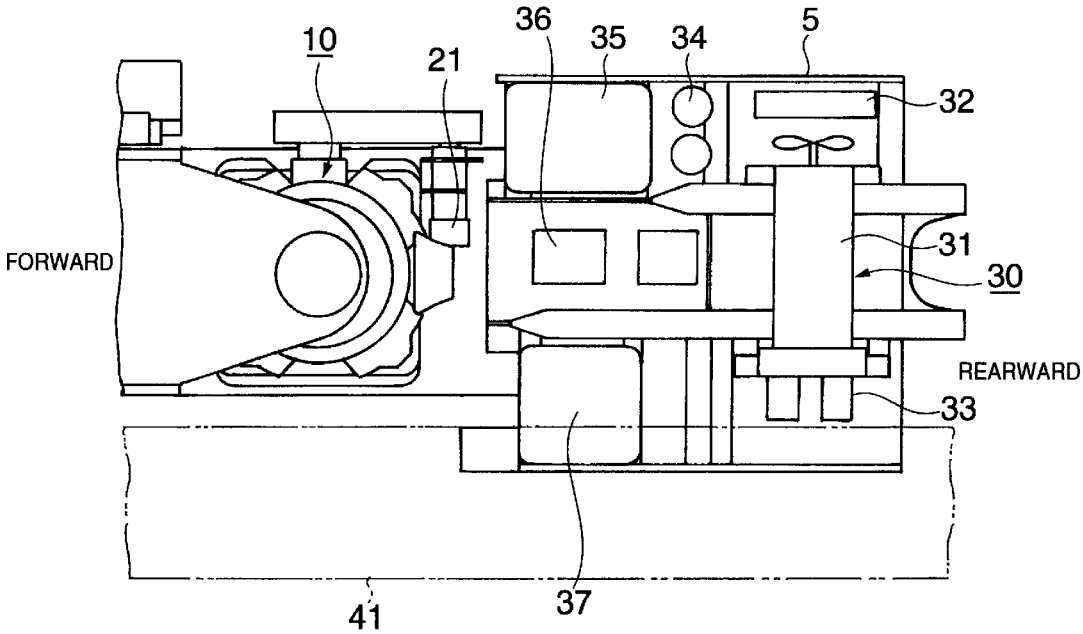
FIG. 7 is an enlarged plan view showing an arrangement of a power source in the power unit.

FIG. 7 is a plan view showing an arrangement of the power source 30 on the stand 5. An engine 31 for supplying a power to the traveling apparatus 3 and the crusher 10 via a hydraulic pump 33 is mounted on a rear portion of the stand 5 in a perpendicular direction to the longitudinal direction of the frame 2. A radiator 32 is arranged in a right side of the rear portion of the stand 5, that is, at an opposite position to the supply conveyor 41. The hydraulic pump 33 for supplying a pressurized fluid to a hydraulic motor 21 driving the crusher 10, a hydraulic motor (not shown) driving each of the conveyors 41, 42 and 43 and the like is attached to the rear end portion of the engine 31. Further, a filter 34 is arranged in a right center portion of the stand 5, and a fuel tank 35 is arranged in a right front portion. An operating valve portion 36 for operating the hydraulic equipment such as the respective hydraulic motors or the like is arranged in a center front portion of the stand 5, and a working fluid tank 37 is arranged in a left front portion. The power source 30 is structured as shown in FIG. 5 such that a periphery thereof is covered by an outer cover. In this case, since the radiator 32 is positioned in an opposite side to the supply conveyor 41, the dropping down earth and sand are hardly sucked by the radiator 32, so that the radiator 32 is hardly clogged.

In accordance with the structure mentioned above, the mobile crushing apparatus 1 in accordance with the present embodiment can obtain the following effects.

(1) Since the input shaft 16 of the crusher 10 is provided in the opposite side to the supply conveyor 41 disposed in the vehicle width direction and in the side direction in which no apparatus disturbing a maintenance operation exists, it is not necessary to provide a predetermined wide working space in any one side of front and rear sides of the crusher 10 as in the prior art, so that it is possible to reduce a length in the longitudinal direction of the mobile crushing apparatus 1. Further, since the crusher 10 is driven by the hydraulic motor 21, a size of the structure is made compact in comparison with the conventional electric motor and no power generator is required. As a result, it is possible to make a whole of the apparatus compact.

(2) Since the input shaft 16 is provided in the perpendicular direction to the vehicle longitudinal direction and in such a manner as to be directed to the opposite side to the supply conveyor 41, it is possible to sufficiently secure a working space for drawing out and attaching the input shaft 16 in a side direction, and no obstacle at a time of working exists there. Accordingly, it is possible to easily dissemble and assemble the input shaft 16 and a maintenance property is improved.

(3) Since the input shaft 16 is provided in the opposite side to the supply conveyor 41 in the vehicle width direction, it is possible to prevent the drive portions such as the input shaft 16, the V belt 23 and the like from being abraded or damaged due to the earth and sand, the stone or the like dropping down from the supply conveyor 41, whereby a service life of the drive portion is improved. Further, since no obstacle such as the supply conveyor or the like exists above the input shaft 16, it is possible to use a crane for assisting the work at a time of maintaining the input shaft 16 and a maintaining operation can be more easily performed.

(4) Since the power source 30 is mounted on the table 5 so as to be formed as one power unit 4, it is possible to arrange various kinds of power equipment in a compact manner with taking a save space into consideration, a compact size can be achieved and a whole of the apparatus can be made compact. Further, since the power unit 4 is previously assembled as a sub-assembly and the power unit 4 is mounted to the frame 3 via the table 5, an assembling property is improved and a labor and time for assembling is reduced.

Figure 8:
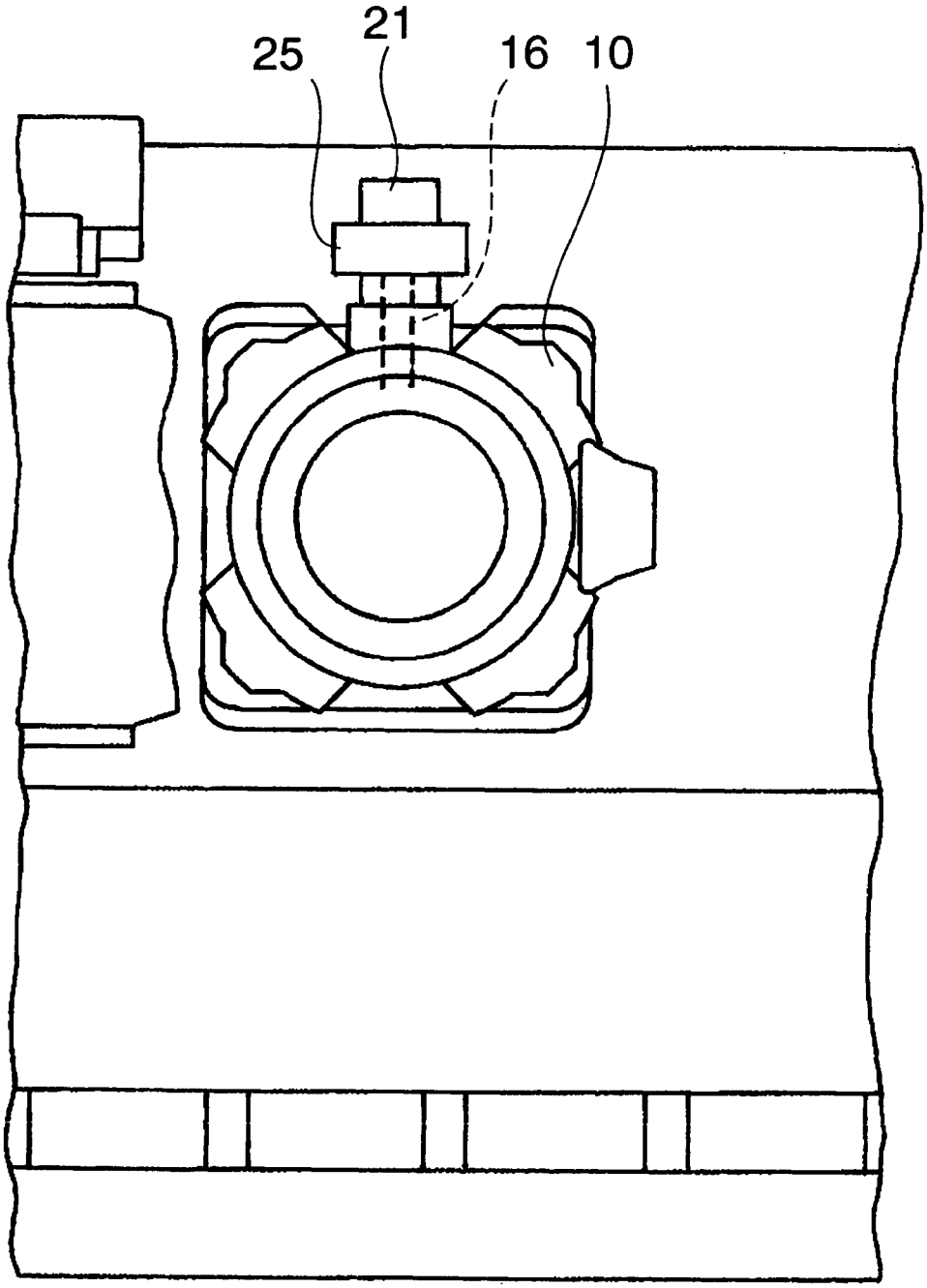
FIG. 8 is an enlarged plan view showing another embodiment with respect to the drive portion of the crusher.

Next, a description will be given of another embodiment with respect to the drive portion of the crusher 10 with reference to FIG. 8. A hydraulic motor 21 is directly connected to a front end portion of the input shaft 16 in the crusher 10 via a reduction gear 25. Accordingly, the same operation and effect as those of the present embodiment can be obtained, and the structure can be made further simple, so that it is possible to make the apparatus compact. Since no driving belt is required, a maintainability can be improved.

In this case, the description is given of the mobile crushing apparatus 1 in the present embodiment, however, the apparatus may be a fixed type. Further, the crusher 10 is described as the cone type, however, the other types such as a jaw, a rotary, a shear of the like may be employed.

Next, a description will be in detail given of a mobile crushing apparatus in accordance with a second embodiment. In this case, the same reference numerals are attached to the same elements as those of the first embodiment, and a detailed description thereof will be omitted.

Figure 9:
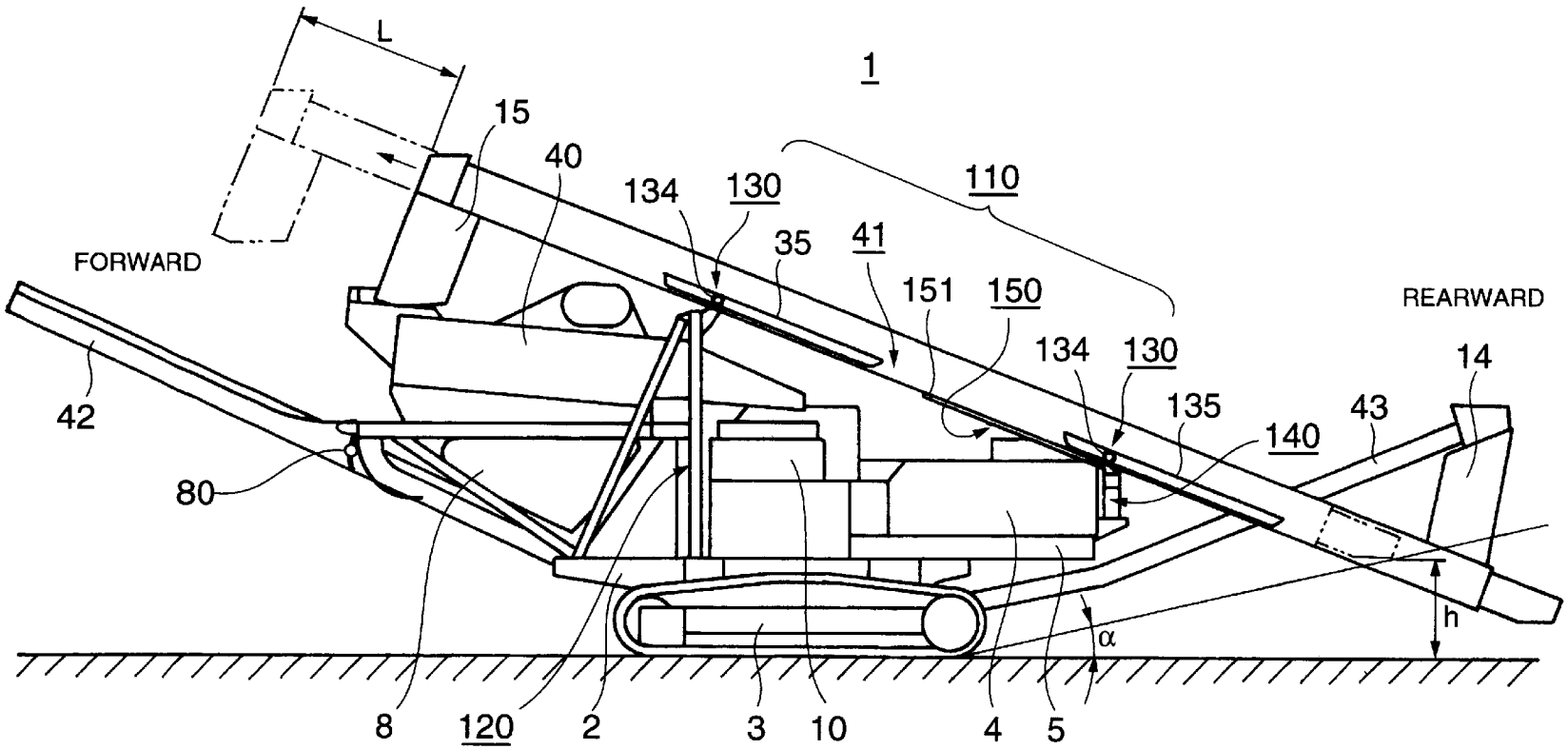
FIG. 9 is a side elevational view of a mobile crushing apparatus in accordance with a second embodiment of the present invention.
Figure 10:
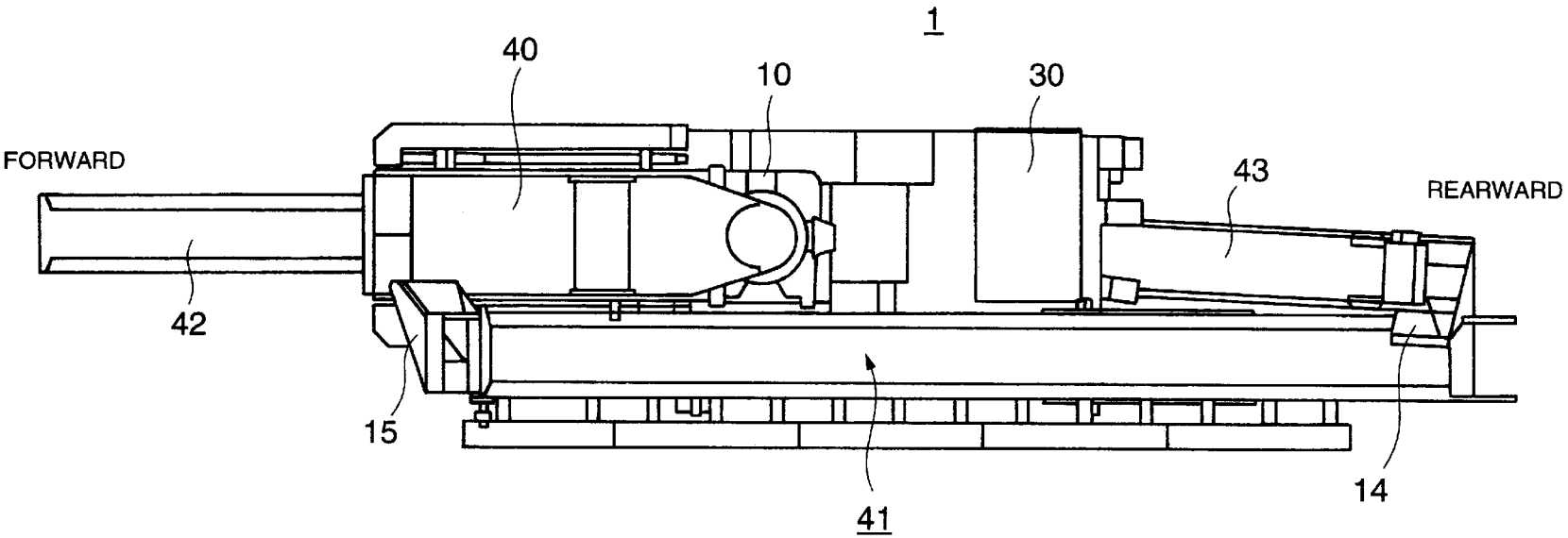
FIG. 10 is a plan view of the mobile crushing apparatus shown in FIG. 9.

FIG. 9 is a side elevational view of the mobile crushing apparatus 1, and FIG. 10 is a plan view of the same. A crusher 10 crushing a material to be crushed such as rocks or the like thrown from the above and discharging the crushed material from the below is mounted on a substantially center portion of a frame 2 having a traveling apparatus 3. A vibrating screen 40 selecting a grain size of the material to be crushed and thereafter supplying the remaining material as the material to be crushed to the crusher is mounted in a front portion of the crusher 10. A power source 30 is mounted on a stand 5 attached to a rear end portion of the frame 2. A supply conveyor 41 supplying the material to be crushed to an upper inlet port of the vibrating screen 40 is arranged in a side of the frame 2 in such a manner as to be inclined forward and upward, and the supply conveyor 41 is connected to the vibrating screen 40 via a first chute 15 attached to a front end portion. Further, a rear end portion of the supply conveyor 41 at a time of operating is positioned near the ground. The front portion of the supply conveyor 41 and the rear portion thereof are respectively supported by a front leg 120 attached to the frame 2 and a rear leg 140 attached to the frame 2 via respective slide apparatuses 130 and 130 in such a manner as to freely move in a longitudinal direction. The slide apparatus 130 has a roller 134 and a rail 135. A slide power portion 150 having a hydraulic cylinder 151 moving the supply conveyor 41 in a longitudinal direction is provided on a lower surface of the supply conveyor 41. The supply conveyor 41, the slide apparatuses 130 and 130 and the slide power portion 150 constitute a transfer apparatus 110.

Further, a return conveyor 43 transferring the crushed material to the supply conveyor 41 is provided below the crusher 10 in such a manner as to be directed rearward and upward. A rear end portion of the return conveyor 43 is connected to the supply conveyor 41 via a second chute 14. A hopper 8 is attached to a lower portion of the vibrating screen 40, and a product conveyor 42 feeding out the product is provided below the hopper 8 in such a manner as to be inclined forward and upward and freely slide. A middle portion of the product conveyor 42 is supported by a vertically moving apparatus 80. A ground clearance of a front end portion of the product conveyor 42 is set to be sufficient to be mounted on a truck or the like.

At a time of crushing, the mobile crushing apparatus 1 loads the aggregate material such as the locks or the like on the rear end portion of the supply conveyor 41 by a loader (not shown). The aggregate material is fed to the vibrating screen 40 via the first chute 15 by the supply conveyor 41, and is riddled by the screen. The good aggregate product satisfying a predetermined grain size is transferred out to the external portion via the hopper 8 by the product conveyor 42. The remaining large material is supplied to the crusher 10 so as to be crushed, and returned to the rear end portion of the supply conveyor 41 via the second chute 14 by the return conveyor 43. The returned crushed material is again fed to the vibrating screen 40 together with the aggregate material loaded by the loader, and the product is made by repeating the operation mentioned above.

Next, a description will be given in detail of a structure of the transfer apparatus 110.

Figure 11:
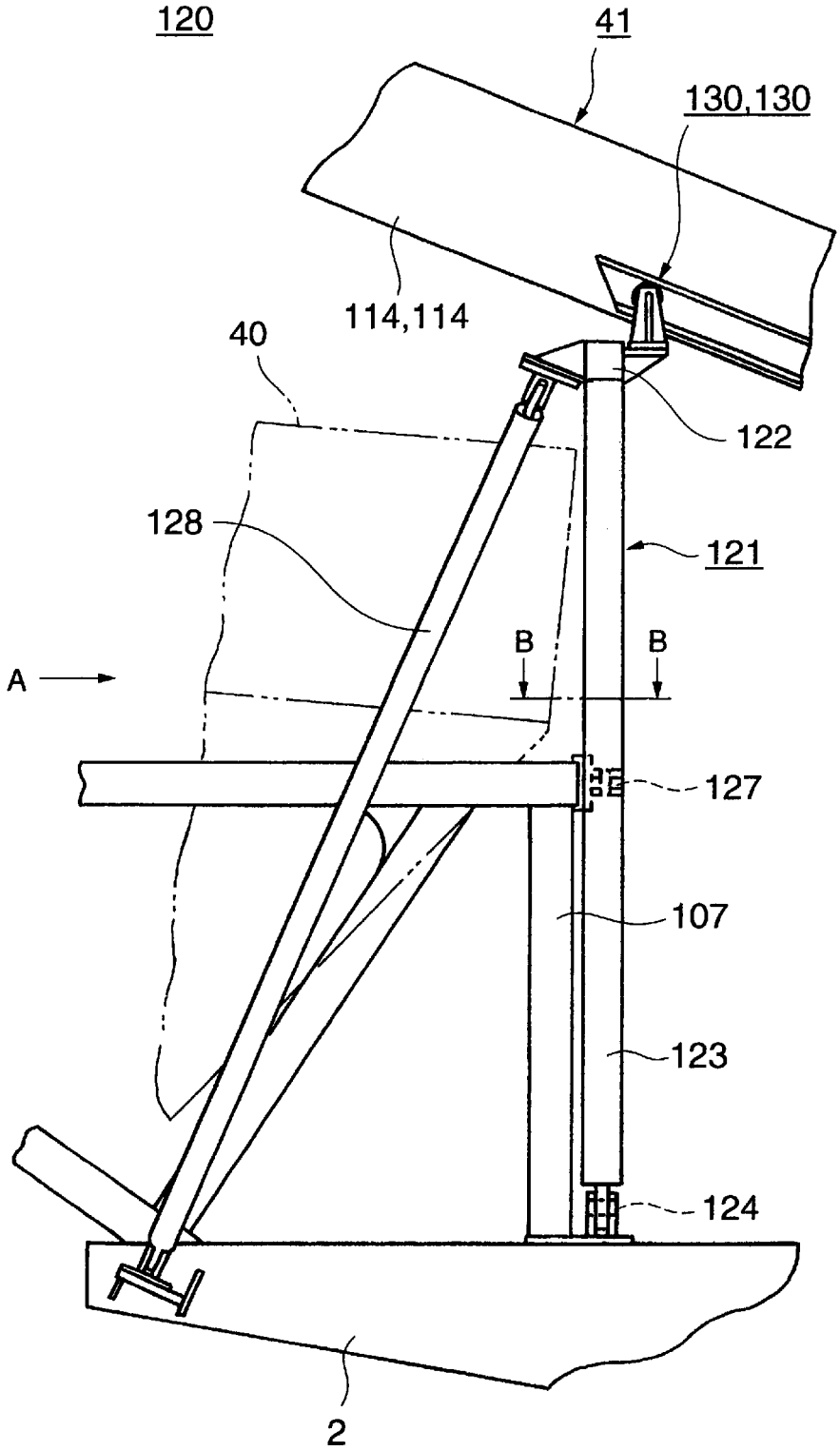
FIG. 11 is an enlarged side elevational view of a front leg supporting a transferring apparatus shown in FIG. 9.
Figure 12:
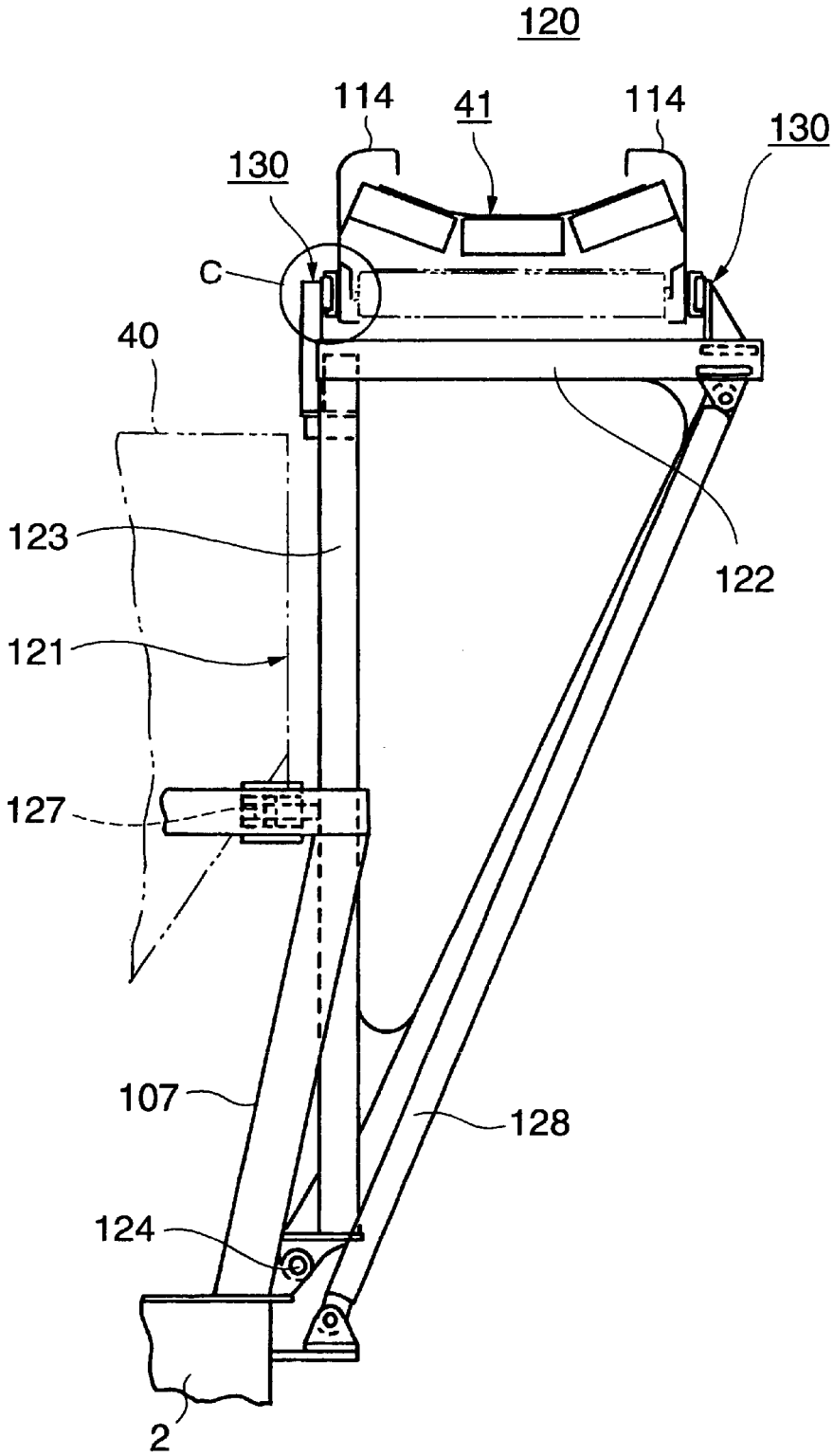
FIG. 12 is a schematic view as seen from an arrow A in FIG. 11.
Figure 13:
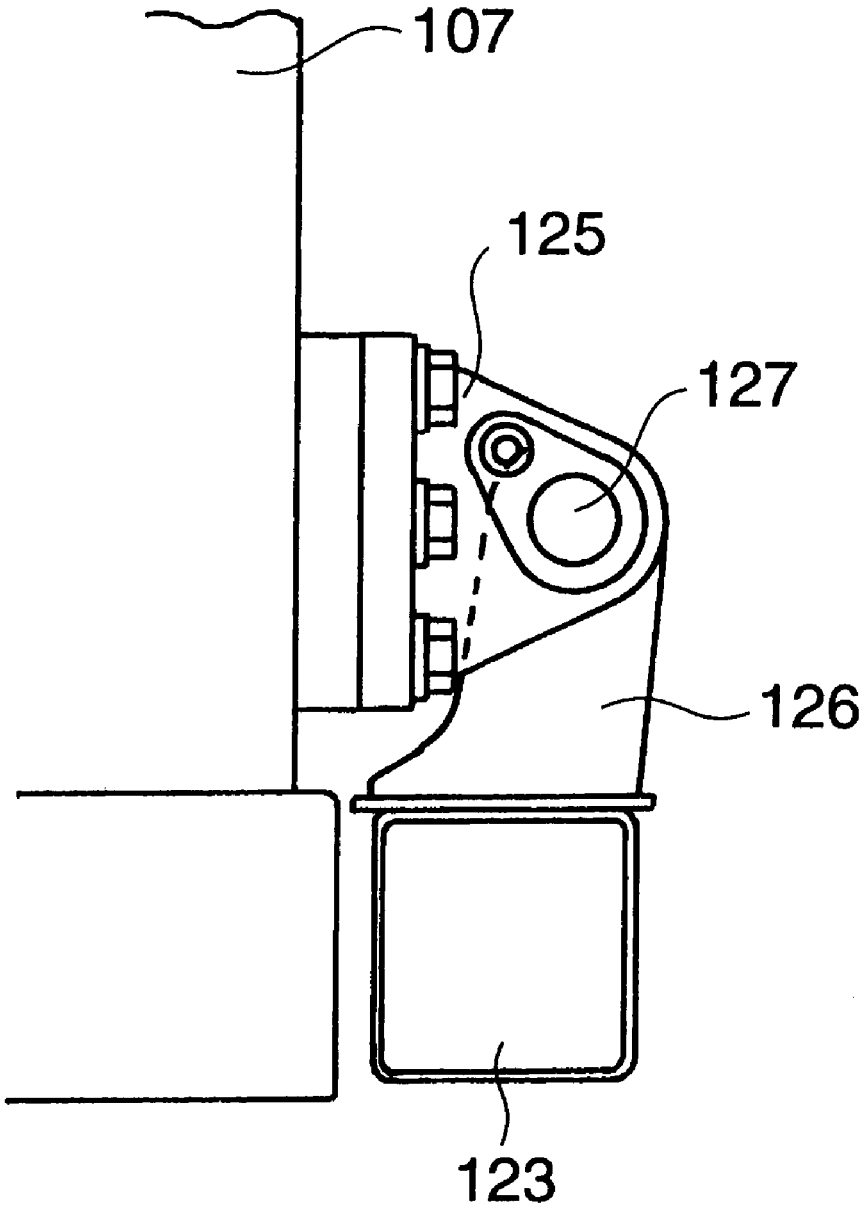
FIG. 13 is a schematic view along a line B—B in FIG. 11.

FIG. 11 is an enlarged side elevational view of the front leg 120 and FIG. 12 is a schematic view as seen from an arrow A in FIG. 11. A triangle frame 121 having a horizontal member 122 in an upper portion and formed in a substantially right triangle is arranged so that the horizontal member 122 is directed in a lateral direction. A lower end portion of a vertical member 123 of the triangle frame 121 is rotatably attached to the frame 2 by a lateral pin 124 having a horizontal axis in a longitudinal direction. FIG. 13 is a schematic view along a line B—B in FIG. 11 and shows a mounting state of a middle portion of the vertical member 123.

In FIGS. 11, 12 and 13, a first bracket 125 attached to a frame body 107 fixed to the frame 2 and supporting the vibrating screen 40, and a second bracket 126 attached to a middle portion in a height direction of the vertical member 123 are connected by a vertical pin 127 having an axis in a vertical direction. One end portion of the horizontal member 122 and the frame 2 are connected by an inclined member 128 so as to prevent the triangle frame 121 from coming down in a longitudinal direction. Further, in FIGS. 11 and 12, the supply conveyor 41 has a pair of outer frames 114 and 114 in a width direction supporting the rollers for the belt. A pair of slide apparatuses 130 and 130 are provided between both end portions in a lateral direction of the horizontal member 122 and right and left side surface portions of a pair of outer frames 114 and 114, and support the front portion of the supply conveyor 41 in such a manner as to freely move in a longitudinal direction.

In accordance with the structure mentioned above, the lower portion of the triangle frame 121 is connected to the frame 2 by the lateral pin 124 which is horizontal in the longitudinal direction, and the middle portion thereof is connected to the frame body 107 by the vertical pin 127 in the vertical direction. Accordingly, even when the frame 107 vibrates in a vertical direction due to an influence of the vibrating screen 40, the triangle frame 121 is not affected thereby.

Figure 14:
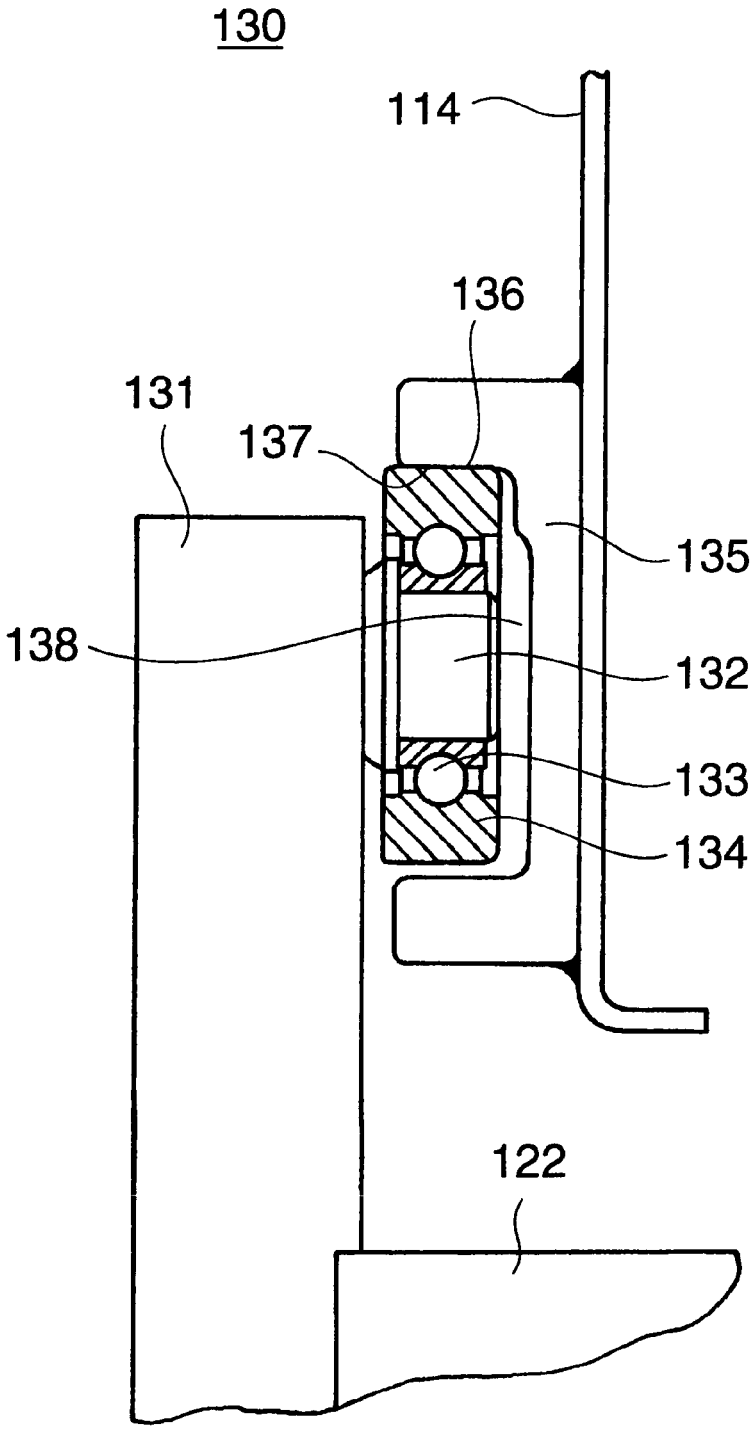
FIG. 14 is an enlarged cross sectional view of a portion C in FIG. 12.

FIG. 14 is an enlarged cross sectional view of a portion C in FIG. 12 and shows a detailed structure of the slide apparatus 130. In FIG. 14, a shaft support 131 is attached to the horizontal member 122, and a roller 134 is rotatably attached to a roller shaft 132 horizontally attached thereto via the bearing 133. A rail 135 having a groove 138 on an outer side surface is fixed to a side surface portion of the outer frame 114 of the supply conveyor 41, the roller 134 is engaged with the groove 138, and an outer peripheral surface 136 of the roller 134 is brought into contact with an inner surface 137 in an upper side of the groove 138.

Accordingly, since a contact surface between the roller 134 and the rail 135 is directed downward, and the earth and sand or the like do not fall over the contact surface even when the earth and sand or the like are stored within the groove 138, the abrasion of the roller 134 and the rail 135 is reduced and a durability is improved.

Figure 15:
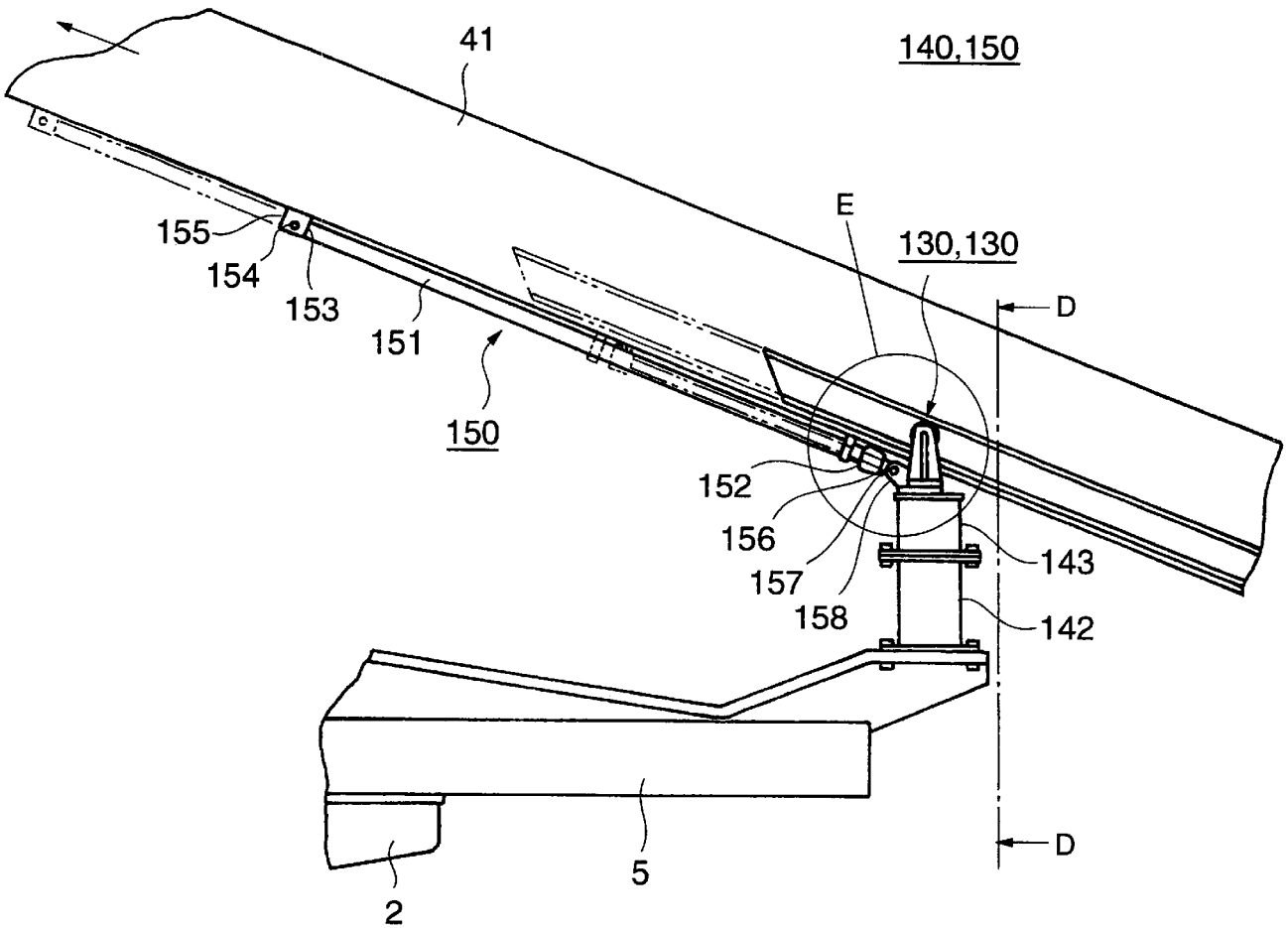
FIG. 15 is an enlarged side elevational view of a rear leg supporting the transferring apparatus shown in FIG. 9.
Figure 16:
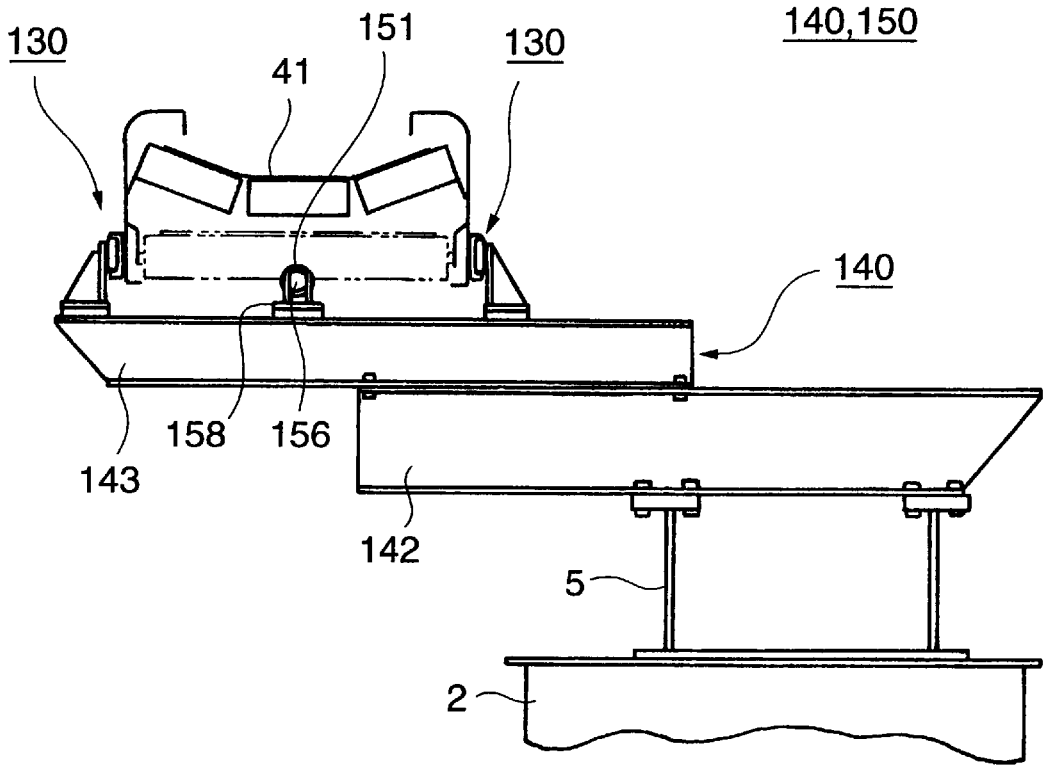
FIG. 16 is a schematic view along a line D—D in FIG. 15.

FIG. 15 is a side elevational view of the rear leg 140 and the slide power portion 150, and FIG. 16 is a schematic view along a line D—D in FIG. 15. In FIGS. 15 and 16, a support table 143 is fixed to the rear end portion of the stand 5 mounted on the rear portion of the frame 2 in such a manner as protrude to one side (that is, a side of the supply conveyor 41) in a lateral direction via a middle member 142. A pair of right and left slide apparatuses 130 and 130 mentioned above are attached to right and left of the support table 143 and both side surface portions of the supply conveyor 41, thereby supporting the rear portion of the supply conveyor 41 in such a manner as to freely move in the longitudinal direction. A slide power portion 150 is arranged on a lower surface of the supply conveyor 41. The cylinder bottom portion 153 of the hydraulic cylinder 151 constituting the slide power portion 150 is connected to a bottom side bracket 155 fixed to the supply conveyor 41 by a first pin 154. A rod head portion 156 of the hydraulic cylinder 151 is connected to a head side bracket 158 attached to the support table 143 by a second pin 157. FIG. 15 shows a state that the hydraulic cylinder 151 is shortest, and when a pressurized fluid is supplied to the bottom side of the hydraulic cylinder 151, the hydraulic cylinder 151 is extended as shown by a double-dot chain line and the supply conveyor 41 moves in a left oblique upward direction (in a direction of an arrow) in FIG. 15 by the slide apparatus 130. In the case of moving the supply conveyor 41 in an upward direction, since the pressurized fluid is applied to the bottom side having a pressure receiving area larger than that of the head side in the hydraulic cylinder 151, a greater driving force can be obtained by a smaller hydraulic pressure. Accordingly, it is possible to employ the compact hydraulic cylinder 151 having a small outer diameter, and it is possible to make a whole of the transfer apparatus light and compact.

Figure 17:
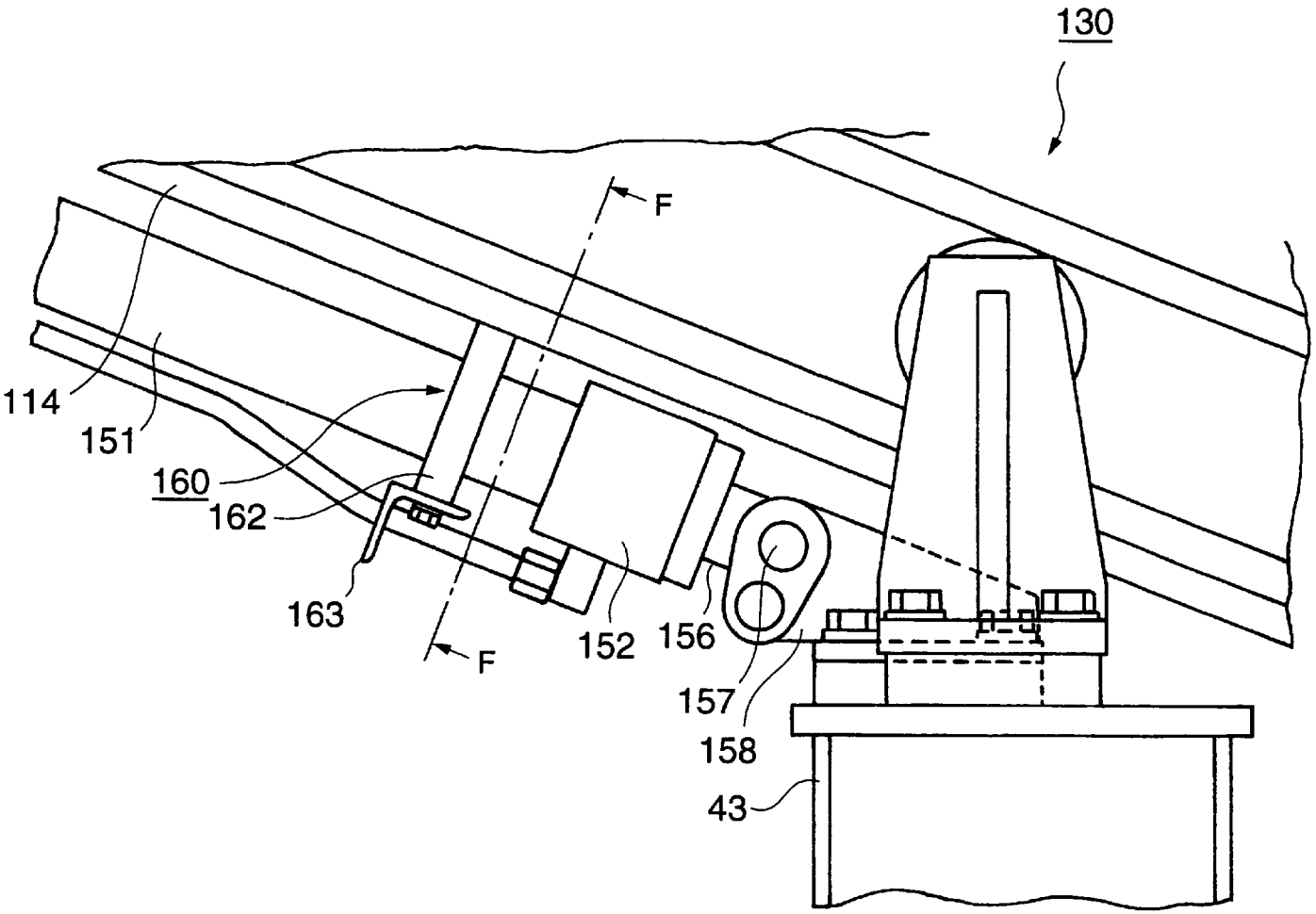
FIG. 17 is an enlarged side elevational view of a portion E in FIG. 15.
Figure 18:
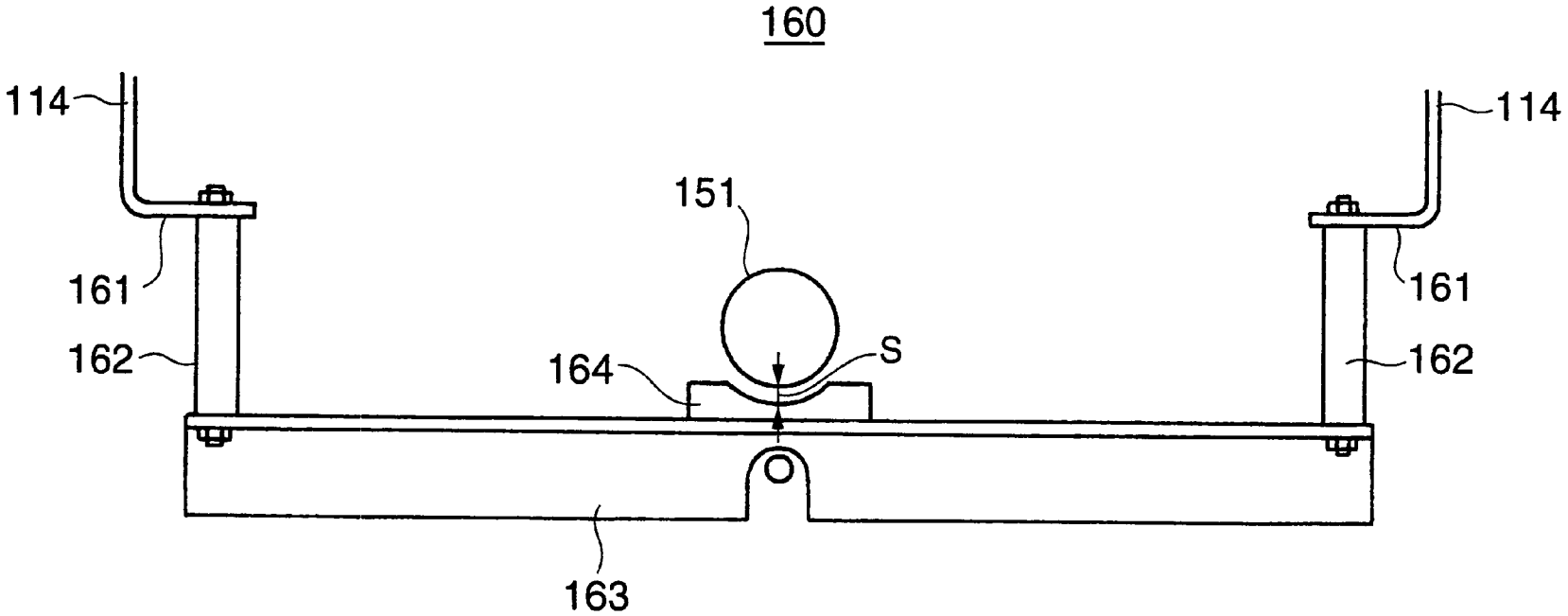
FIG. 18 is a schematic view along a line F—F in FIG. 17.

FIG. 17 is an enlarged side elevational view of a portion E in FIG. 15. In FIG. 17, a buckling preventing apparatus 160 is provided near the cylinder head portion 152 of the hydraulic cylinder 151. FIG. 18 is a schematic view along a line F—F in FIG. 17 and shows a structure of the buckling preventing apparatus 160. In FIGS. 17 and 18, an angle member 163 is attached to both of lower surfaces 161 and 161 of the right and left outer frames 114 and 114 of the supply conveyor 41 respectively via spacers 162 and 162 so as to extend between both of the lower surfaces 161 and 161. A receiving member 164 is attached to a portion between an upper surface of the angle member 163 and the hydraulic cylinder 151. A predetermined gap S is provided between the receiving member 164 and the hydraulic cylinder 151 in a vertical direction with respect to an axis. When extending the hydraulic cylinder 151, the hydraulic cylinder 151 is going to generate a deflection downward so as to generate a buckling due to a narrow and long structure, however, since the hydraulic cylinder 151 is prevented from being deflected by the angle member 163 and each of the spacers 162 and 162 via the receiving member 164 at this time, it is possible to prevent the buckling from being generated.

Figure 19:
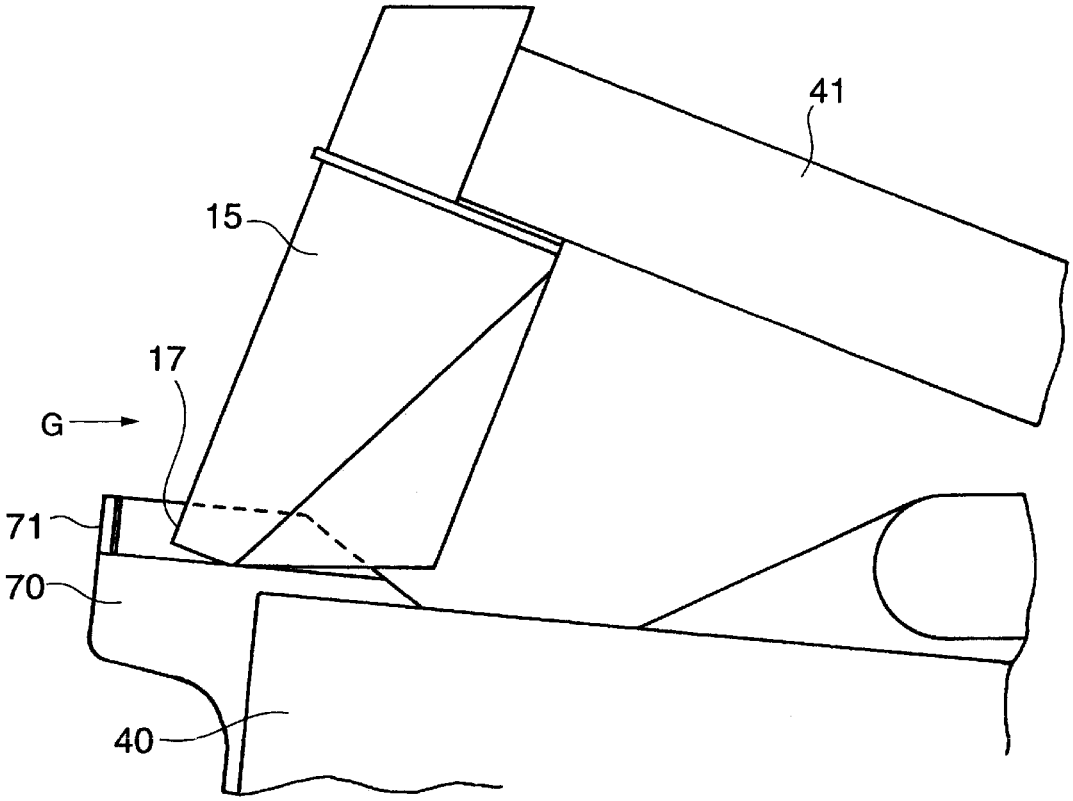
FIG. 19 is an enlarged side elevational view of a front end portion of the supply conveyor shown in FIG. 9.
Figure 20:
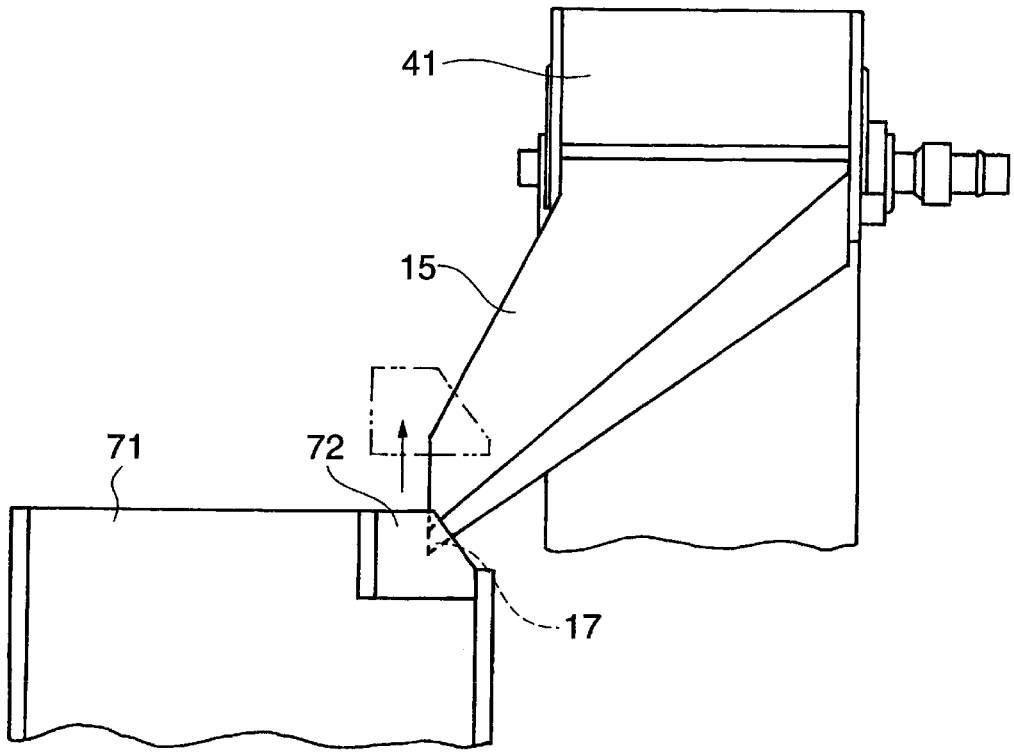
FIG. 20 is a schematic view as seen from an arrow G in FIG. 19.

FIG. 19 is a side elevational view of a front end portion in a side of the vibrating screen 40 of the supply conveyor 41, and FIG. 20 is a schematic view as seen from an arrow G in FIG. 19. In FIGS. 19 and 20, a front end portion 17 of the first chute 15 attached to the front end portion of the supply conveyor 41 is positioned in a lower side from an upper edge of a vibrating screen hopper 70 attached to an upper end portion of the vibrating screen 40. Accordingly, when sliding the supply conveyor 41 in the longitudinal direction by the slide apparatus 130 mentioned above with keeping this state, the first front end portion 17 is interfered with the vibrating screen hopper 70. Accordingly, as shown in FIG. 20, a first inserting plate 72 freely inserting and drawing off is provided in a portion of a front surface plate 71 opposing to the first front end portion 17 of the first chute 15. In the case of sliding the supply conveyor 41 upward, the interference is prevented by drawing off the first inserting plate 72 in a direction of an arrow as shown by a double-dot chain line in FIG. 20.

Figure 21:
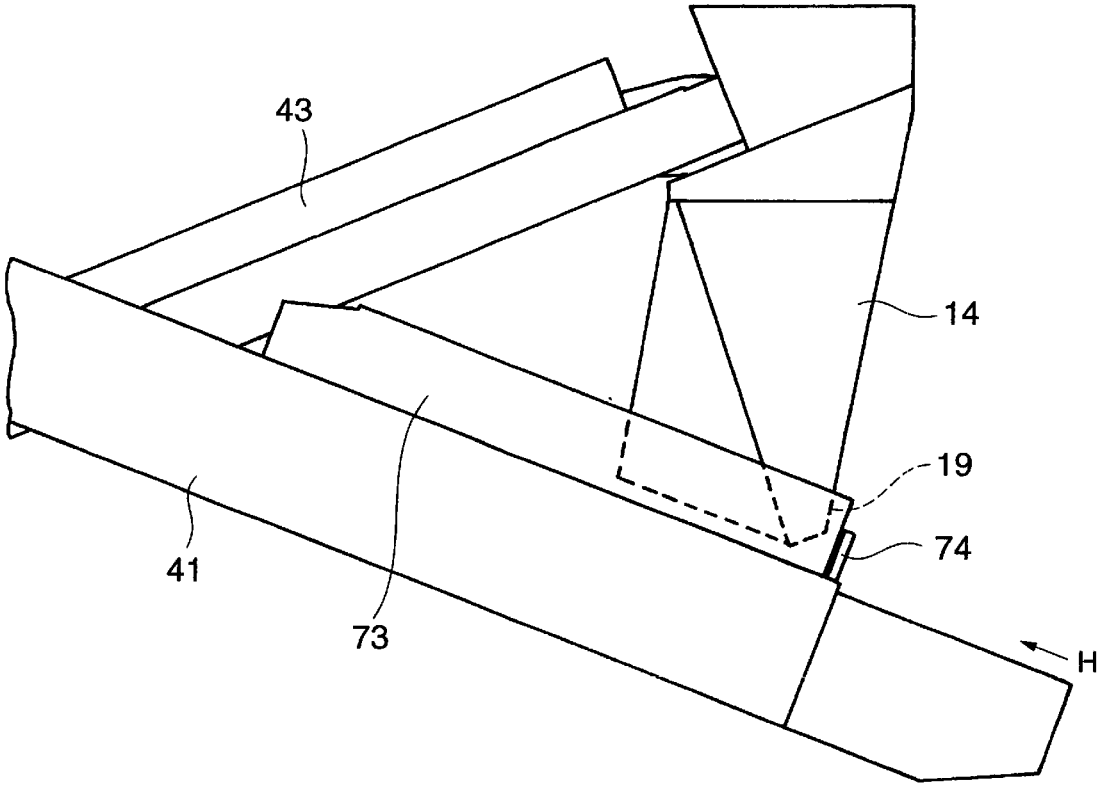
FIG. 21 is an enlarged side elevational view of a rear end portion of the supply conveyor shown in FIG. 9.
Figure 22:
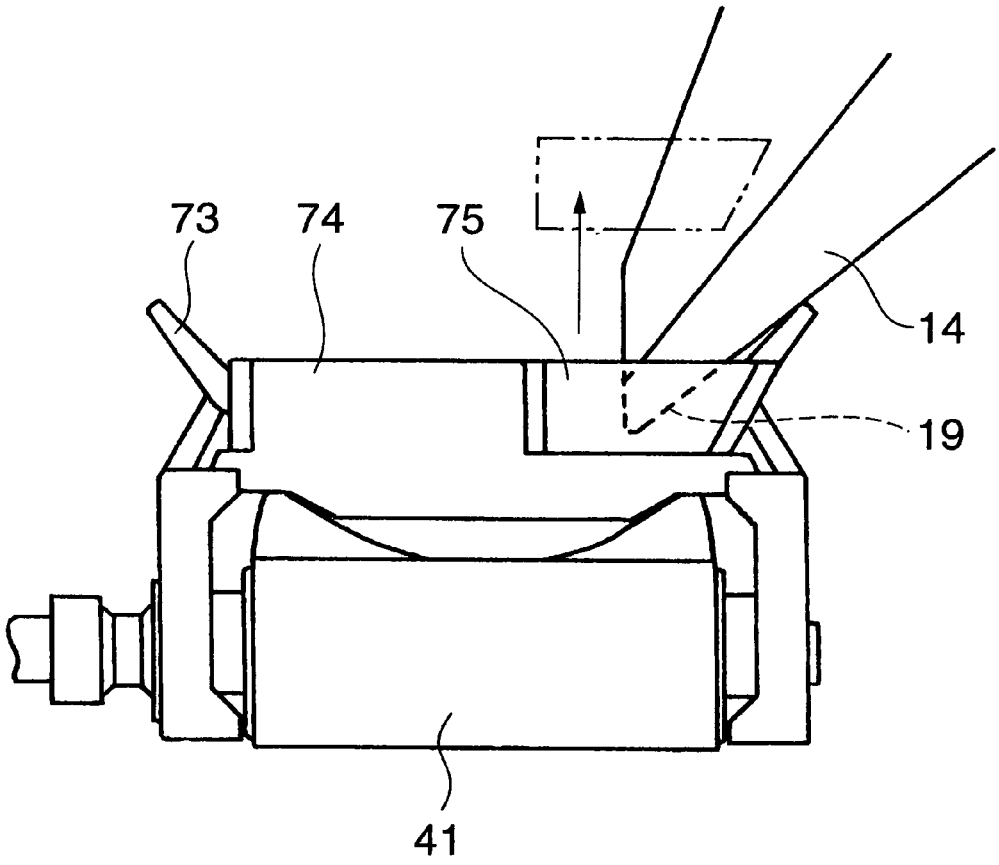
FIG. 22 is a schematic view as seen from an arrow H in FIG. 21.

FIG. 21 is a side elevational view of a rear end portion of the supply conveyor 41, and FIG. 22 is a schematic view as seen from an arrow H in FIG. 21. In FIGS. 21 and 22, a second front end portion 19 of the second chute 14 attached to the rear end portion of the return conveyor 43 is positioned at a lower side from the upper edge of the supply conveyor hopper 73 provided in the rear end portion of the supply conveyor 41. Accordingly, when sliding the supply conveyor 41 in the longitudinal direction with keeping this state, the second front end portion 19 is interfered with the supply conveyor hopper 73. Therefore, as shown in FIG. 22, a second inserting plate 75 freely inserting and drawing off is provided in a portion of a rear surface plate 74 opposing to the second front end portion 19 of the second chute 14. In the case of sliding the supply conveyor 41 upward, the interference is prevented by drawing off the second inserting plate 75 in a direction of an arrow as shown by a double-dot chain line in FIG. 22.

Next, a description will be given of a sliding operation in a longitudinal direction of the transfer apparatus 110 in accordance with the present embodiment. At a time of crushing operation, the supply conveyor 41 is descended downward by compressing the hydraulic cylinder 151 of the slide power portion 150 as shown by a solid line in FIG. 9 and the rear end portion of the supply conveyor 41 is descended near the ground surface, whereby the material to be crushed can be easily loaded from the loader. Further, at a time of moving between the working fields, as described with reference to FIGS. 20 and 22, the first inserting plate 72 and the second inserting plate 75 are drawn off. Next, as described with reference to FIG. 15, the pressurized fluid is supplied to the bottom side of the hydraulic cylinder 151 of the slide power portion 150 so as to extend the hydraulic cylinder 151, thereby moving the supply conveyor 41 oblique upward (in the direction of the arrow) via the slide apparatus 130 as shown by the double-dot chain line in FIG.

9. A moving amount at this time is set to L. As a result, the minimum ground clearance h of the rear end portion of the supply conveyor 41 after being moved becomes sufficiently high, and it is possible to set a liftoff angle a of the present mobile crushing apparatus 1 to a sufficiently large level.

Accordingly, even at a time of climbing up or traveling on a rolling road between the working fields, there is no risk that the supply conveyor 41 is brought into contact with the ground obstacle so as to be damaged. At a time of being changed to the moving attitude, it is possible to perform the change only by extending the hydraulic cylinder 151 so as to slide the supply conveyor 41 by the slide apparatus 130, so that the operation can be simply and easily performed and an operability can be improved. Further, since it is possible to prevent the supply conveyor 41 and the ground surface from being in contact with each other by a simple structure of the slide, the transfer apparatus can be made compact and can be manufactured at a low cost.

Figure 23:
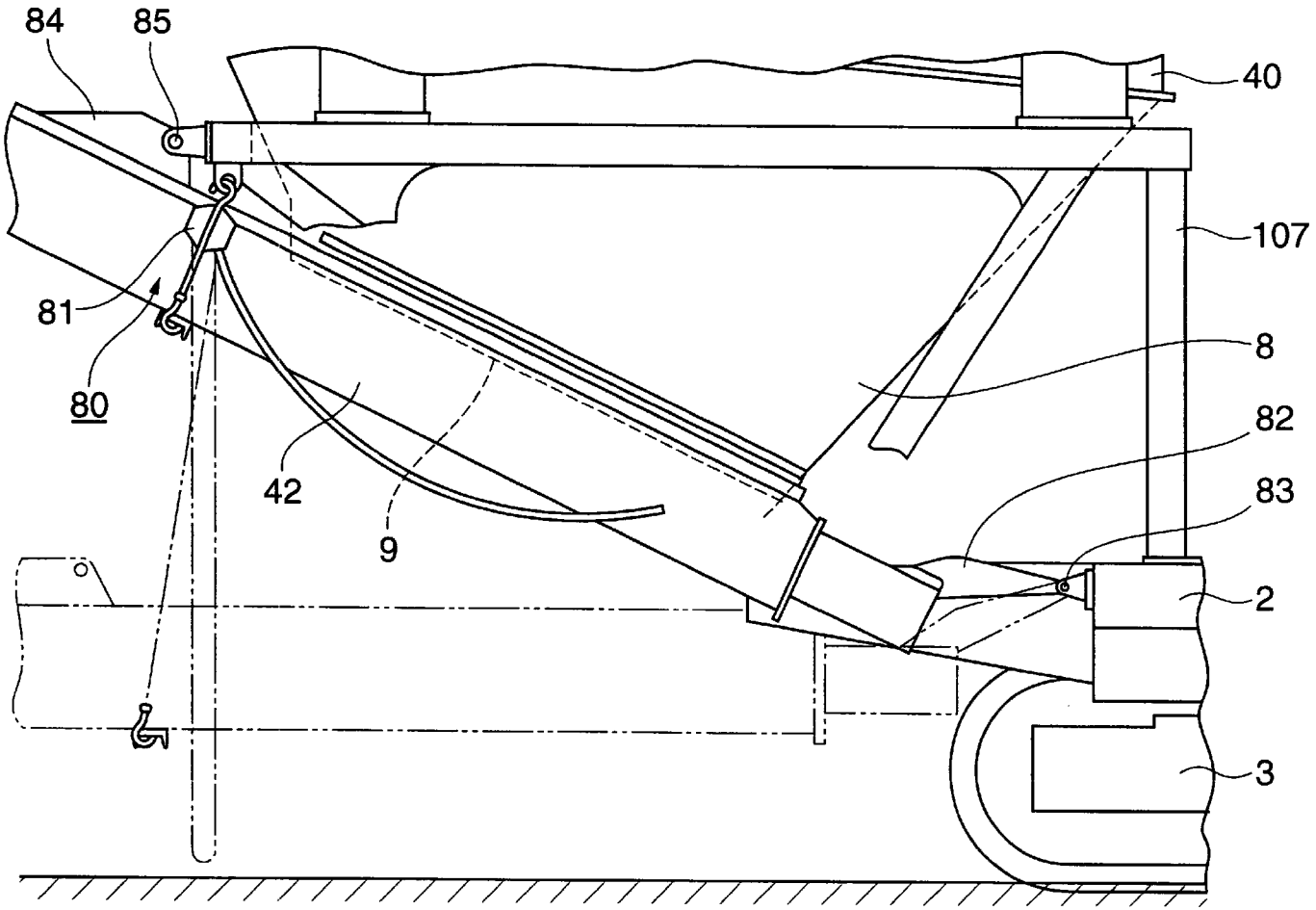
FIG. 23 is an enlarged side elevational view of a vertically moving apparatus in a product conveyor shown in FIG. 9.

FIG. 23 is a side elevational view of the vertically moving apparatus 80 of the product conveyor 42. In FIG. 23, a base end portion 82 of the product conveyor 43 is attached to the front end portion of the frame 2 by a connecting pin 83 in such a manner as to freely swing. The frame body 107 mounting the vibrating screen 40 thereon is fixed to the front end portion of the frame 2. A bracket 84 provided in a substantially middle portion in the longitudinal direction of the product conveyor 42 is detachably supported to the front end portion of the frame body 107 by a support pin 85. In this state, the product conveyor 42 is closely attached to a lower surface opening portion 9 of the hopper 8. Further, the front end portion of the frame body 107 and the substantially middle portion in the longitudinal direction of the product conveyor 42 are connected to each other via a manual winch 81 constituting the vertically moving apparatus 80. In this case, the manual winch 81 may be replaced by an electric type or the like.

Next, a description will be given of an operation of the vertically moving apparatus 80. At a time of working, as shown by a solid line in FIG. 23, a bracket 84 of the product conveyor 42 is attached to the frame body 107 by the supporting pin 85 and the lower surface opening portion 9 of the hopper 8 is closely attached to the product conveyor 42, whereby a working attitude is set. In the case of maintaining or cleaning an interior portion of the hopper 8, a maintenance attitude is set by drawing off the support pin 85, descending the product conveyor 42 by the winch 81 so as to swing around the connecting pin 83 and moving to a position shown by a double-dot chain line. Accordingly, the lower surface opening portion 9 of the hopper 8 is opened, and the maintenance and cleaning can be easily performed. Further, it is possible to maintain the product conveyor 42.

After finishing the maintenance and the cleaning, the product conveyor 42 is ascended by the winch 81 so as to be swung to the working attitude at the position shown by the solid line, and is fixed by the support pin 85. Accordingly, it is possible to change the attitude between the working attitude and the maintenance attitude for a short time, and an operating efficiency is improved.

Figure 24:
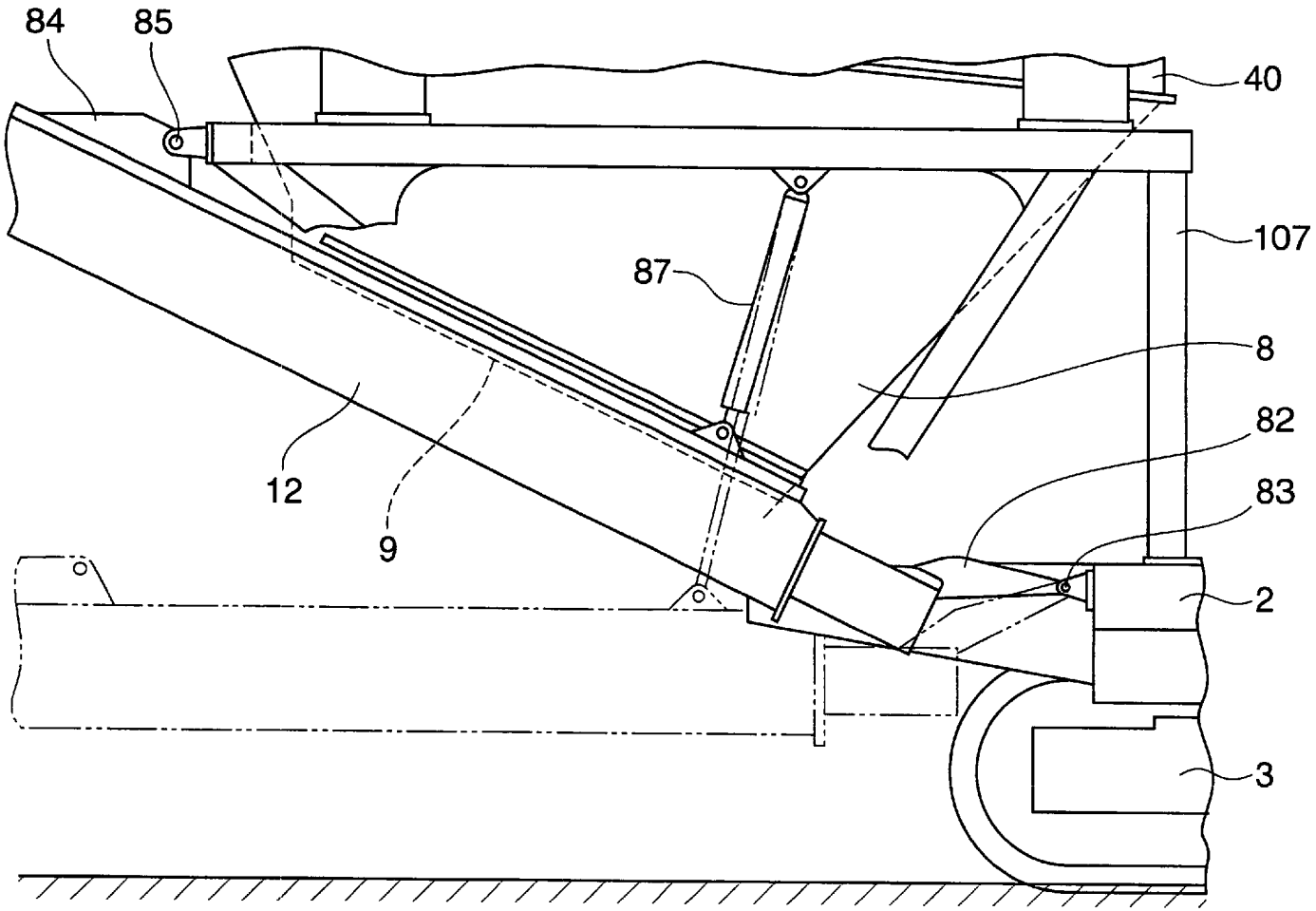
FIG. 24 is an enlarged side elevational view of another embodiment with respect to the vertically moving apparatus in the product conveyor.

FIG. 24 is a side elevational view of another embodiment with respect to the vertically moving apparatus for the product conveyor 42. The same reference numerals are attached to the same elements as those of the vertically moving apparatus 80 shown in FIG. 23, and a description thereof will be omitted. In FIG. 24, the frame body 107 and the product conveyor 42 are connected to each other by a hydraulic cylinder 87. The hydraulic cylinder 87 is operated by a hydraulic apparatus (not shown). At a time of maintaining the interior portion of the hopper 8, the support pin 85 is drawn off and the hydraulic cylinder 87 is extended, whereby the product conveyor 12 is swung to the maintenance attitude position shown by a double-dot chain line. At a time of operating, as shown by a solid line, the hydraulic cylinder 87 is compressed so as to swing the product conveyor 42 upward, and attach to the frame body 107 by the support pin 85, thereby setting in the working attitude. In accordance with the present embodiment, in addition to the operation and effect of the vertically moving apparatus 80 mentioned above, it is possible to correspond to an automation by automatically driving the hydraulic cylinder 87.

Figure 25:
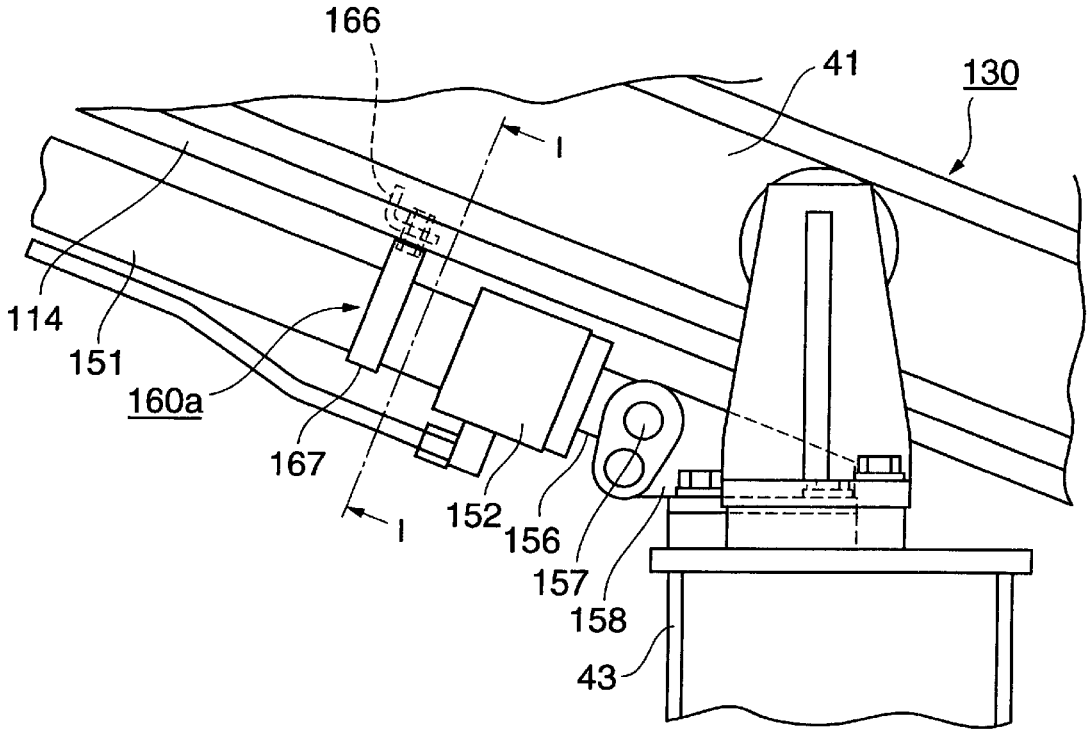
FIG. 25 is an enlarged side elevational view of another embodiment with respect to a hydraulic cylinder buckling preventing apparatus in a slide apparatus.
Figure 26:
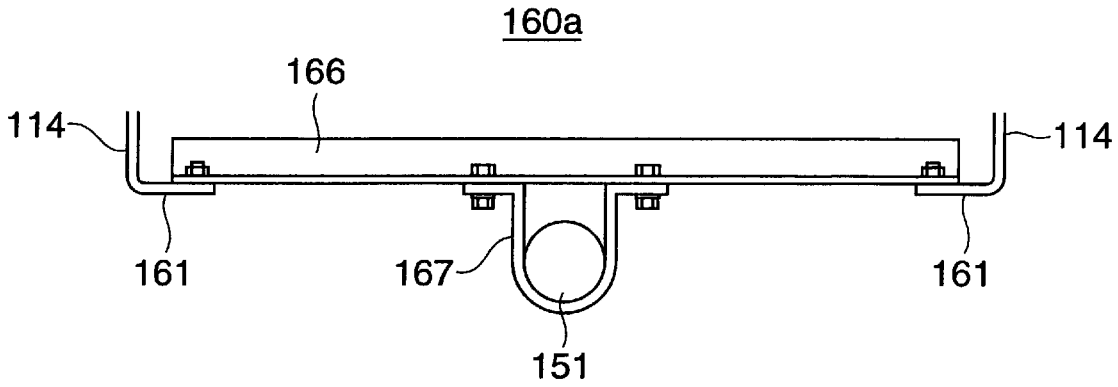
FIG. 26 is a schematic view along a line I—I in FIG. 25.
Figure 27:
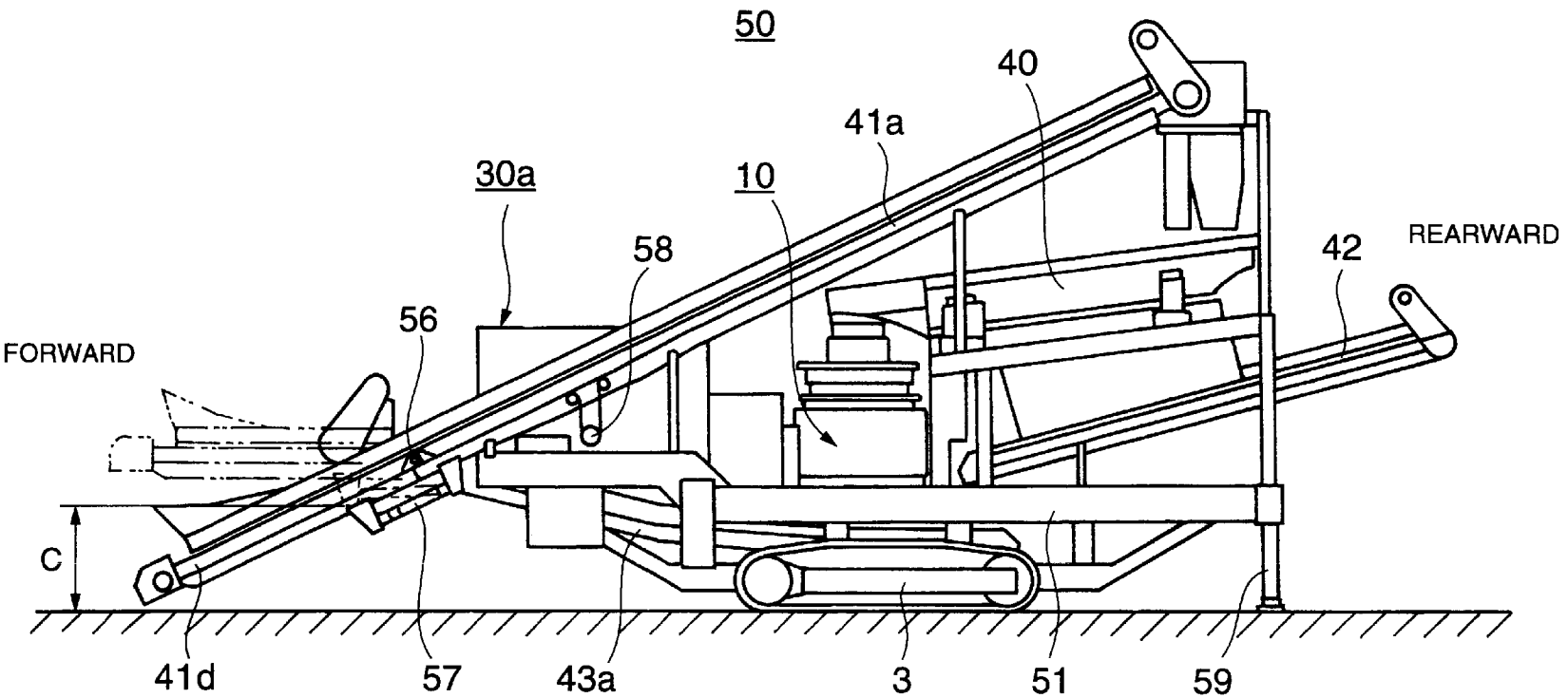
FIG.27 PRIOR ART
FIG. 27 is a side elevational view of a mobile crushing apparatus in accordance with a first embodiment of the prior art.
Figure 28:
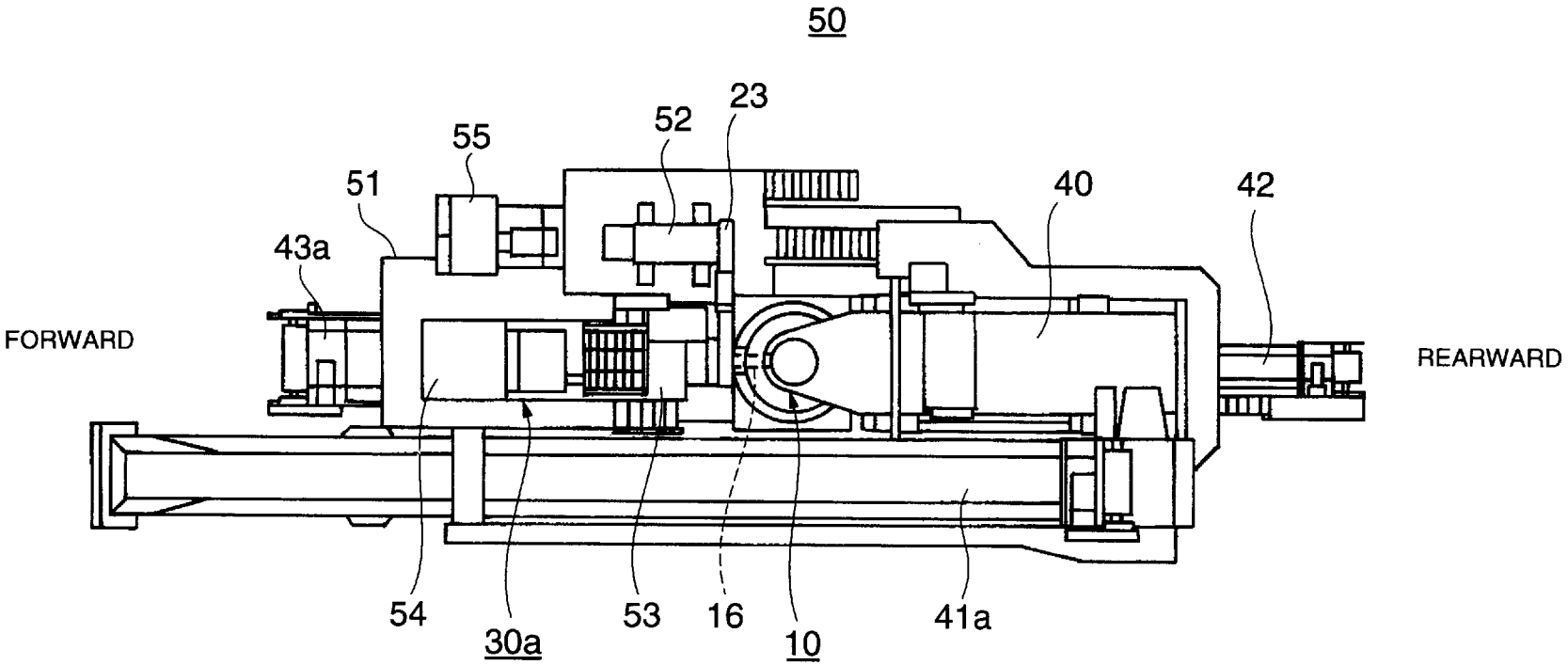
FIG.28 PRIOR ART
FIG. 28 is a plan view of the mobile crushing apparatus shown in FIG. 27.
Figure 29:
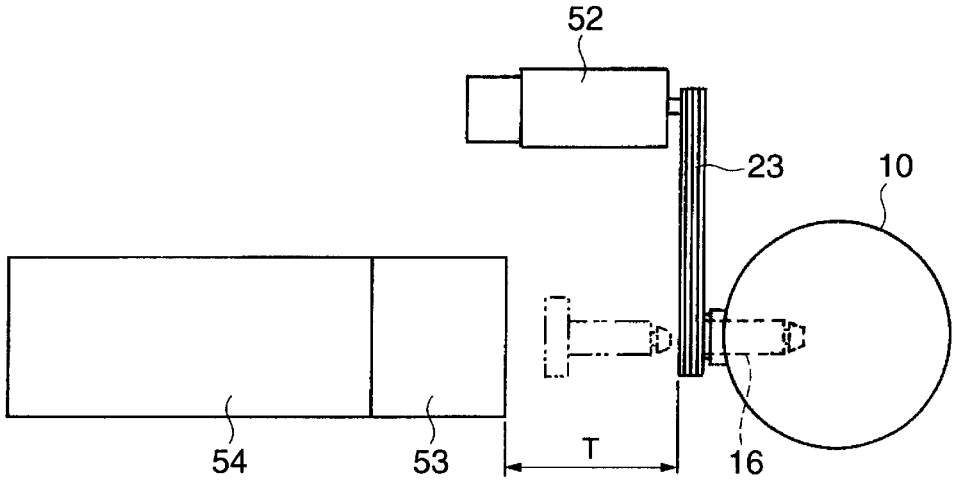
FIG.29 PRIOR ART
FIG. 29 is a schematic view describing an arrangement of a power source equipment with respect to the mobile crushing apparatus shown in FIG. 27.
Figure 30:
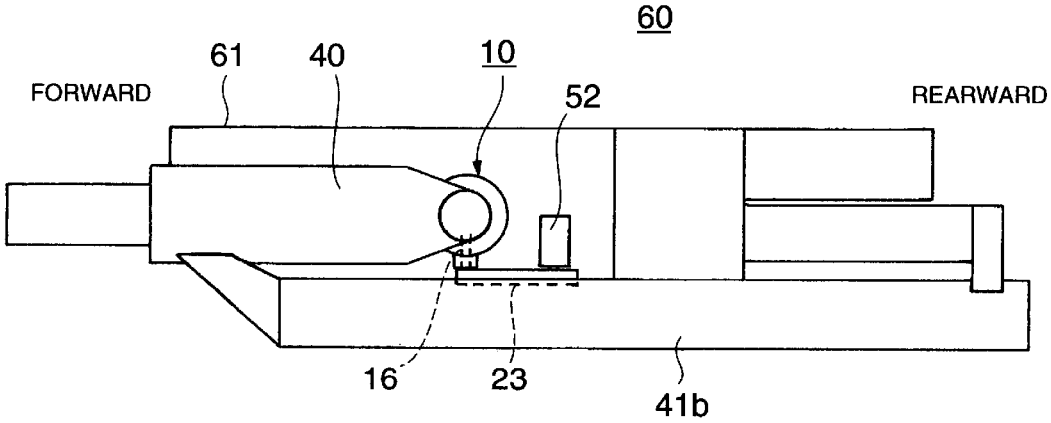
FIG.30 PRIOR ART
FIG. 30 is a plan view of a mobile crushing apparatus in accordance with a second embodiment of the prior art.
Figure 31:
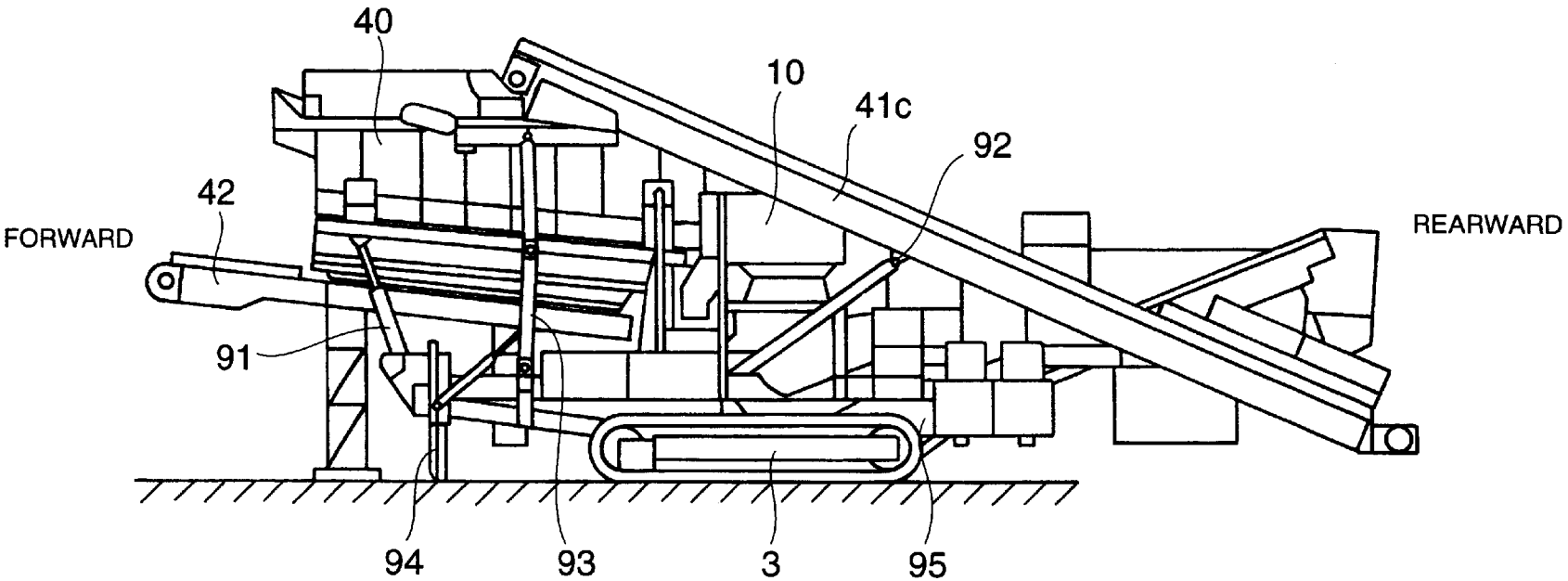
FIG.31 PRIOR ART
FIG. 31 is a side elevational view in a working state of a mobile crushing apparatus in accordance with a third embodiment of the prior art.
Figure 32:
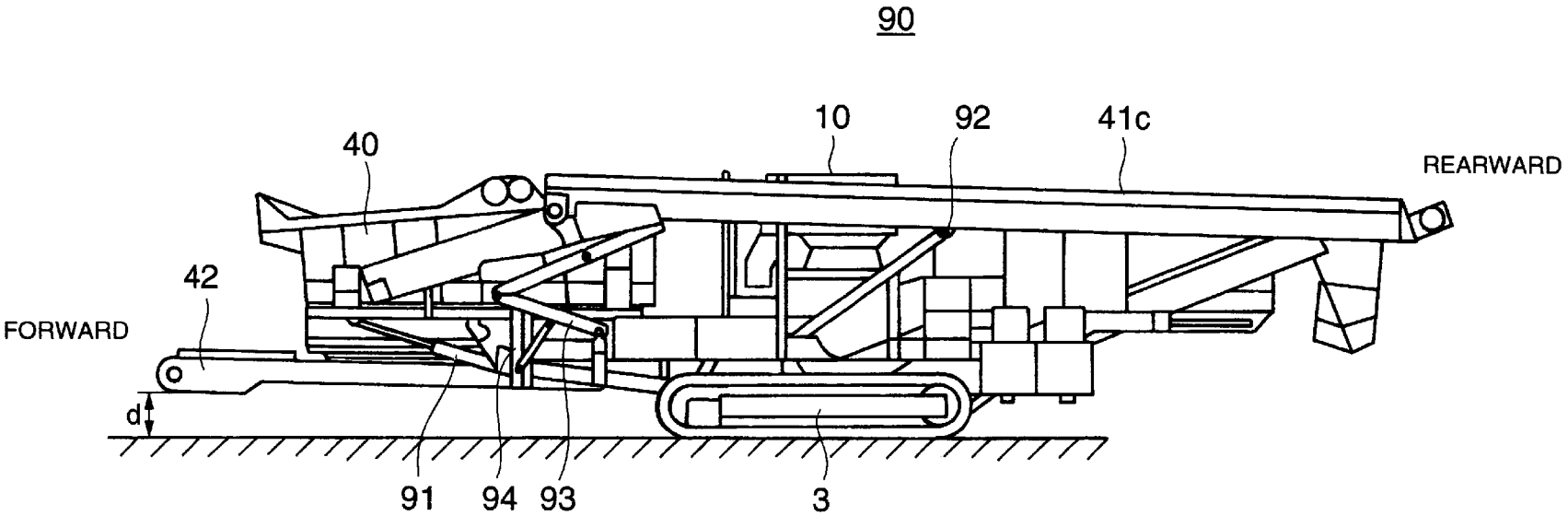
FIG.32 PRIOR ART
FIG. 32 is a side elevational view in a traveling state of the mobile crushing apparatus shown in FIG. 31.

FIGS. 25 and 26 show another embodiment with respect to a buckling preventing apparatus 160*a* of the hydraulic cylinder 151 in the slide apparatus 130. The same reference numerals are attached to the same elements as those of the buckling preventing apparatus 160 shown in FIGS. 17 and 18, and a description thereof will be omitted. In FIGS. 25 and 26, the buckling preventing apparatus 160*a* of the hydraulic cylinder 151 has an angle member 166 and a bracket 167. The angle member 166 is attached to both of the lower surfaces 161 and 161 of the right and left outer frames 114 and 114 in the supply conveyor 41 so as to extend between both of the lower surfaces 161 and 161, and the bracket 167 is attached to the lower surface of the substantially center portion of the angle member 166. The bracket 167 has a U-shaped cross sectional shape, a center convex portion of the U shape is directed downward, the hydraulic cylinder 151 is supported from the below with being held within an inner side of the U shape, and an upper end portion of the bracket 167 is attached to the angle member 166. In accordance with the structure of the present embodiment, since the deflection generated downward when the hydraulic cylinder 151 extends can be also restricted by the angle member 166 via the bracket 167, it is possible to prevent the buckling from being generated.

In the mobile crushing apparatus 1 in accordance with the present invention, it is possible to self-propel by the traveling apparatus 3 at a time of moving between the working fields, and on the contrary, in the case of moving on an open road, the vibrating screen 40, the supply conveyor 41, the front leg 120 and the like are taken out and loaded on the truck or the like so as to be transferred by the vehicle. At this time, since the front leg 120 is attached to the frame 2 in accordance with the pin connection, it is easy to dissemble and assemble them and a transfer performance by the truck or the like can be improved.

Further, in the mobile crushing apparatus 1 in accordance with the present invention, the material to be crushed is transferred by the supply conveyor 41 and is supplied to the crusher 10 via the vibrating screen 40, however, the structure is not limited to this, for example, may be directly supplied to the crusher 10 without passing through the vibrating screen 40. In this case, the crushed material may be discharged to the external portion by the return conveyor provided below the crusher 10, or a working process may be made in such a manner that the vibrating screen 40 is provided between the crusher 10 and the supply conveyor 41.

What is claimed is:

1. A mobile crushing apparatus comprising:

an elongated frame;

a power unit attached to the frame;

a crusher mounted on the frame for crushing rocks;

a vibrating screen for selecting a material to be crushed and supplying the material to the crusher;

a supply conveyor for supplying a material to be crushed to the vibrating screen; and a return conveyer for returning the crushed material to the supply conveyor;

wherein said supply conveyor is provided solely on one side in a width direction of said frame and in an upper position of said power unit, an input shaft for inputting a driving power to said crusher is provided on another side in the width direction of said frame, and said mobile crushing apparatus is arranged with the supply conveyor, the vibrating screen, the crusher, and the return conveyor so that a closed cycle is performed by repeating such operations as supplying, selecting, crushing, and returning the material.

2. A mobile crushing apparatus as claimed in claim 1, wherein:

the power unit supplies power to the crusher and the supply conveyor;

which is mounted on the frame, wherein said power unit, including an engine and a hydraulic pump, is previously arranged on a stand so as to constitute a unitized sub-assembly power unit, and wherein the unitized sub-assembly power unit is mounted on said frame via said stand.

3. A mobile crushing apparatus, comprising:

an elongated frame having a traveling apparatus;

a crusher for crushing rocks; and a supply conveyor for transferring a material to be crushed to the crusher, the crusher and the supply conveyor being mounted on the frame, and the mobile crushing apparatus further comprises a slide apparatus supporting said supply conveyor so as to freely move in a longitudinal direction of the supply conveyor, a slide power portion for moving said supply conveyor by the slide apparatus, wherein said slide apparatus is provided with a roller and a rail having a groove engaged with the roller, the roller is rotatably attached to said frame, and the rail is provided in said supply conveyor, wherein said slide power portion is provided with a hydraulic cylinder for moving said supply conveyor, the hydraulic cylinder is arranged so that a cylinder head portion is directed downward along said supply conveyor, and a cylinder bottom portion and a rod head portion of the hydraulic cylinder are respectively attached to a side of said supply conveyor and a side of said frame.

* * * * *